US011118742B2

(12) United States Patent
Hamer et al.

(10) Patent No.: US 11,118,742 B2
(45) Date of Patent: Sep. 14, 2021

(54) DETACHABLE ELECTRICAL CONNECTION FOR FLAT LIGHTING MODULE

(71) Applicant: OLEDWorks LLC, Rochester, NY (US)

(72) Inventors: John Hamer, Rochester, NY (US); Michael Scott Garner, North Barrington, IL (US); Bruno Primerano, Honeoye Falls, NY (US); Jeffrey Jackson, Warsaw, NY (US); Steve Rapp, Rochester, NY (US)

(73) Assignee: OLEDWorks LLC, Rochester, NY (US)

( * ) Notice: Subject to any disclaimer, the term of this patent is extended or adjusted under 35 U.S.C. 154(b) by 613 days.

(21) Appl. No.: 16/076,166

(22) PCT Filed: Feb. 24, 2017

(86) PCT No.: PCT/US2017/019281

§ 371 (c)(1),
(2) Date: Aug. 7, 2018

(87) PCT Pub. No.: WO2017/147373

PCT Pub. Date: Aug. 31, 2017

(65) Prior Publication Data

US 2020/0248880 A1 Aug. 6, 2020

Related U.S. Application Data

(60) Provisional application No. 62/300,503, filed on Feb. 26, 2016.

(51) Int. Cl.
*F21K 9/278* (2016.01)
*F21S 6/00* (2006.01)
(Continued)

(52) U.S. Cl.
CPC ..... *F21K 9/278* (2016.08); *F21S 6/003* (2013.01); *F21V 19/04* (2013.01); *F21V 21/30* (2013.01);
(Continued)

(58) Field of Classification Search
CPC . H01L 2251/5631; H01R 33/00; H01R 33/76; H01R 33/02; H01R 33/18;
(Continued)

(56) References Cited

U.S. PATENT DOCUMENTS 4,626,742 A 12/1986 Mental
5,634,820 A * 6/1997 Vakil ..... F21S 8/00 439/646
(Continued)

FOREIGN PATENT DOCUMENTS

CN 1462162 A 12/2003
JP 3153221 B1 8/2009
(Continued)

OTHER PUBLICATIONS

Proteras, "Lighting Fixture", 2014, JP2014203672, Espacenet Patent Translate https://worldwide.espacenet.com/publicationDetails/biblio?CC=JP&NR=2014203672A (Year: 2014).*
(Continued)

*Primary Examiner* — Rajarshi Chakraborty
*Assistant Examiner* — Michael Chiang

(57) ABSTRACT

A flat and detachable electrical connection system between a flat lighting module and a lampholder is described. The flat lighting module comprises a lighting panel, control circuitry for controlling the lighting panel, and electrical contact pads connected to the control circuitry, all supported at least in part by a mechanical support plate; the mechanical support plate being at least partially enclosed in a housing with a provision or opening so that light can be emitted from the lighting panel; and where the mechanical support plate includes a male mechanical support connector section that extends out from the mechanical support plate in the same plane as the thickness of the lighting module; and where the male mechanical support connector section includes means
(Continued)

for non-permanent locking or latching of the lighting module to the lampholder. The lampholder comprises a female mechanical connector into which the male mechanical support connector section of the lighting module engages and which includes means for non-permanent locking or latching of the male mechanical support connector section of the lighting module; and a male electrical extension that extends out from the female mechanical connector and which engages the electrical contact pads in the lighting module to supply electrical power or communication signals or both to the control circuitry when the lighting module and lampholder are connected. The lighting panel may be LED or OLED and the electrical connection system may be used in a luminaire or lamp.

21 Claims, 33 Drawing Sheets

(51) Int. Cl.

| | |
|---|---|
| ***F21V 19/04*** | (2006.01) |
| ***F21V 21/30*** | (2006.01) |
| ***F21V 23/06*** | (2006.01) |
| ***H01R 13/20*** | (2006.01) |
| ***H01R 33/02*** | (2006.01) |
| ***H01R 13/04*** | (2006.01) |
| *F21Y 115/15* | (2016.01) |
| *F21Y 105/00* | (2016.01) |

(52) U.S. Cl.
CPC ..... *F21V 23/06* (2013.01); *H01R 13/04* (2013.01); *H01R 13/20* (2013.01); *H01R 33/02* (2013.01); *F21Y 2105/00* (2013.01); *F21Y 2115/15* (2016.08)

(58) Field of Classification Search
CPC ..... H01R 13/04; H01R 13/05; H01R 13/20; H01R 13/26; F21V 23/06; F21V 21/002; F21V 19/0005; F21V 19/001; F21V 19/0025; F21V 19/004; F21V 19/04; F21V 19/0045; F21V 19/0065; F21V 21/30; F21K 9/278; F21S 6/003
See application file for complete search history.

(56) References Cited

U.S. PATENT DOCUMENTS

| | | | | |
|---|---|---|---|---|
| 6,565,231 | B1 * | 5/2003 | Cok | F21S 6/002 313/504 |
| 6,776,496 | B2 | 8/2004 | Cok | |
| 6,787,990 | B2 | 9/2004 | Cok | |
| 6,819,036 | B2 | 11/2004 | Cok | |
| 7,034,470 | B2 | 4/2006 | Cok et al. | |
| 7,040,910 | B2 | 5/2006 | Nagata et al. | |
| 7,510,400 | B2 | 3/2009 | Glovatsky et al. | |
| 7,665,864 | B2 * | 2/2010 | Zheng | F21S 2/005 362/249.11 |
| D641,916 | S | 7/2011 | Witsch | |
| 8,884,502 | B2 * | 11/2014 | Aurongzeb | F21V 17/10 313/110 |
| 9,121,593 | B2 | 9/2015 | Hayashi et al. | |
| 9,577,376 | B1 * | 2/2017 | Tsai | H01R 13/629 |
| 9,945,547 | B2 | 4/2018 | Farrnbacher et al. | |
| 2003/0222558 | A1 | 12/2003 | Cok | |
| 2003/0222578 | A1 | 12/2003 | Cok | |
| 2004/0032727 | A1 * | 2/2004 | Cok | F21K 9/00 362/84 |
| 2004/0160768 | A1 * | 8/2004 | Cok | F21S 6/005 362/647 |
| 2005/0148241 | A1 * | 7/2005 | Kohen | H02G 3/20 439/21 |
| 2005/0207165 | A1 | 9/2005 | Shimizu et al. | |
| 2008/0091250 | A1 | 4/2008 | Powell | |
| 2009/0109631 | A1 | 4/2009 | Imai | |
| 2010/0182788 | A1 | 7/2010 | Luo | |
| 2013/0208453 | A1 | 8/2013 | Lin et al. | |
| 2014/0104857 | A1 | 4/2014 | Spintge et al. | |
| 2015/0300613 | A1 | 10/2015 | Zaderej | |
| 2016/0084445 | A1 | 3/2016 | Zhang et al. | |
| 2017/0105265 | A1 * | 4/2017 | Sadwick | F21K 9/238 |
| 2017/0146203 | A1 * | 5/2017 | Belaidi | H05B 45/60 |

FOREIGN PATENT DOCUMENTS

| | | | |
|---|---|---|---|
| JP | 3153221 | U | 8/2009 |
| JP | 2011028856 | A | 2/2011 |
| JP | 2011204387 | A | 10/2011 |
| JP | 2014203672 | A * | 10/2014 |
| JP | 2014203672 | A1 | 10/2014 |
| JP | 2014238981 | A | 12/2014 |
| KR | 10-2006-0081277 | A | 7/2006 |
| WO | 2017147373 | A1 | 8/2017 |

OTHER PUBLICATIONS

Office Action Received for CN Patent Application No. 201780008613.1, dated Dec. 16, 2019, 11 pages (see Attached sheet.

International Search Report and Written Opinion received for PCT Application No. PCT/US2017/019281, dated Aug. 31, 2017, 11 pages.

"Supplementary European Search Report" (European Patent Office) of corresponding International Patent Application Serial No. PCT/US2017/019281, dated Aug. 2, 2019.

* cited by examiner

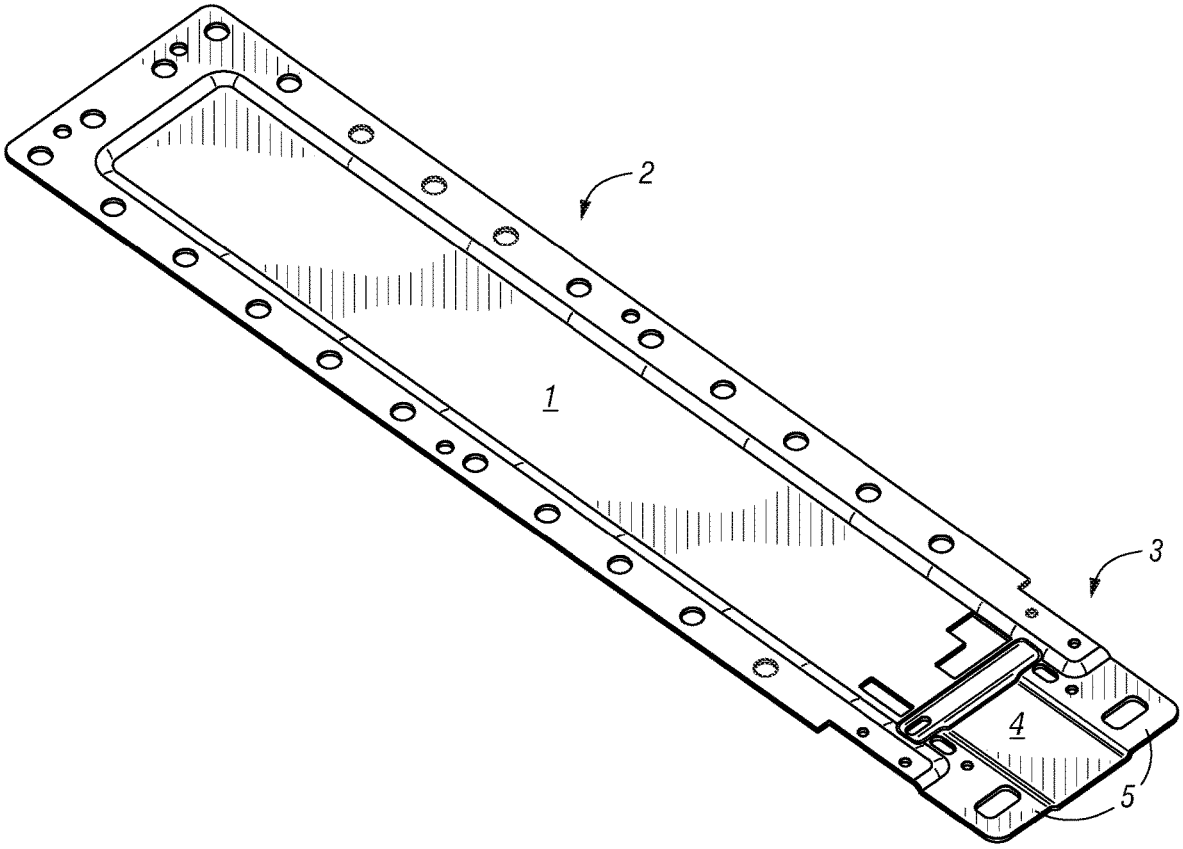
FIG. 1A
FIG. 1B
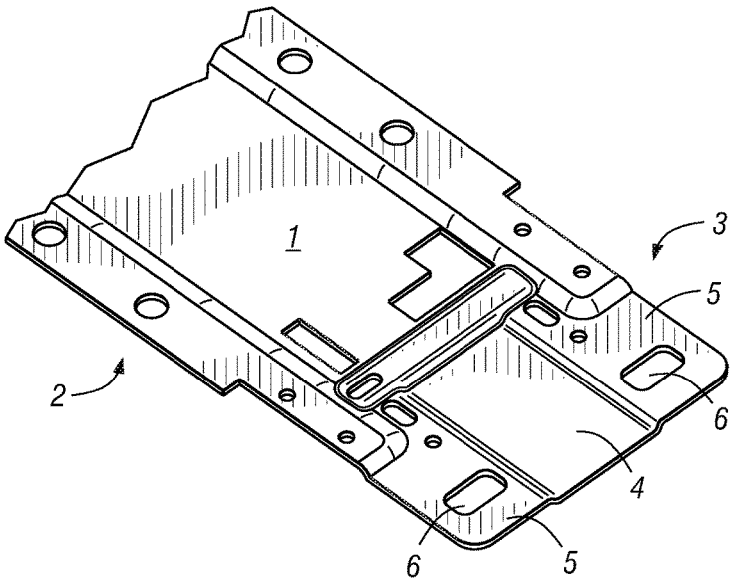

FIG. 2A
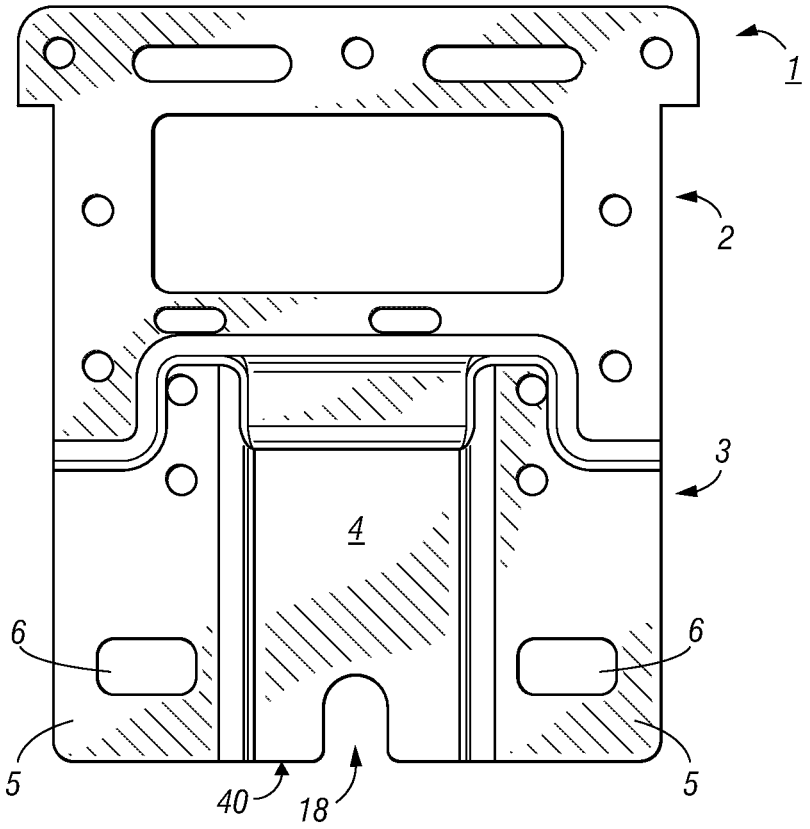
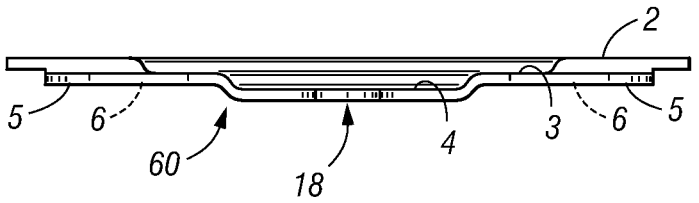
FIG. 2B

FIG. 5A
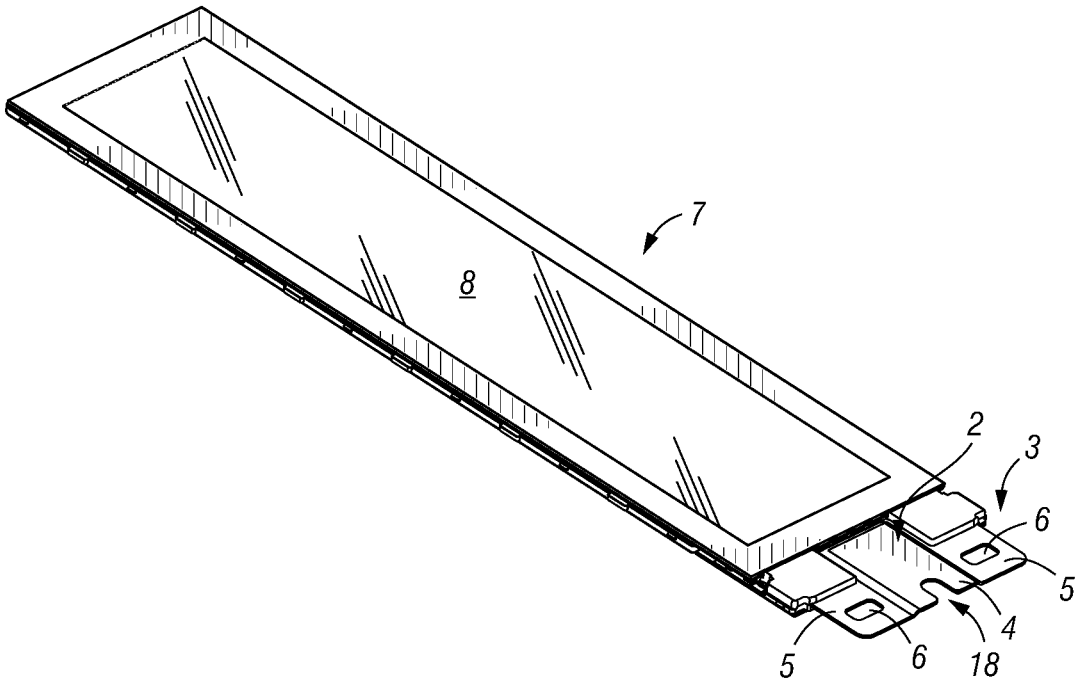
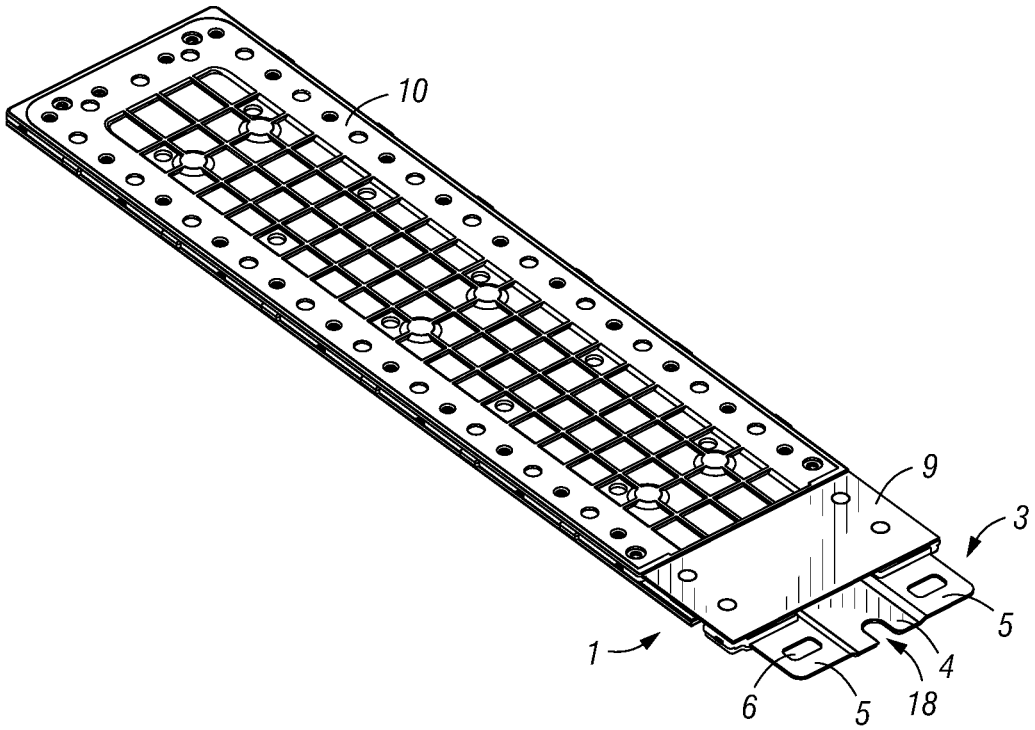
FIG. 5B

FIG. 18A
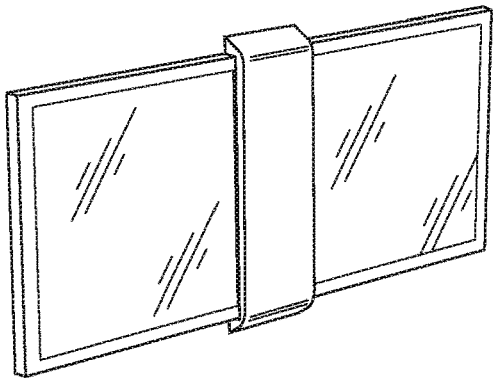
FIG. 18B
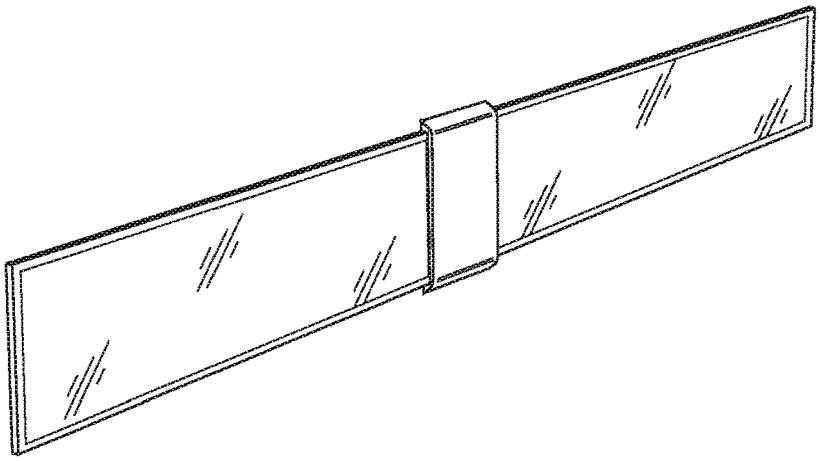
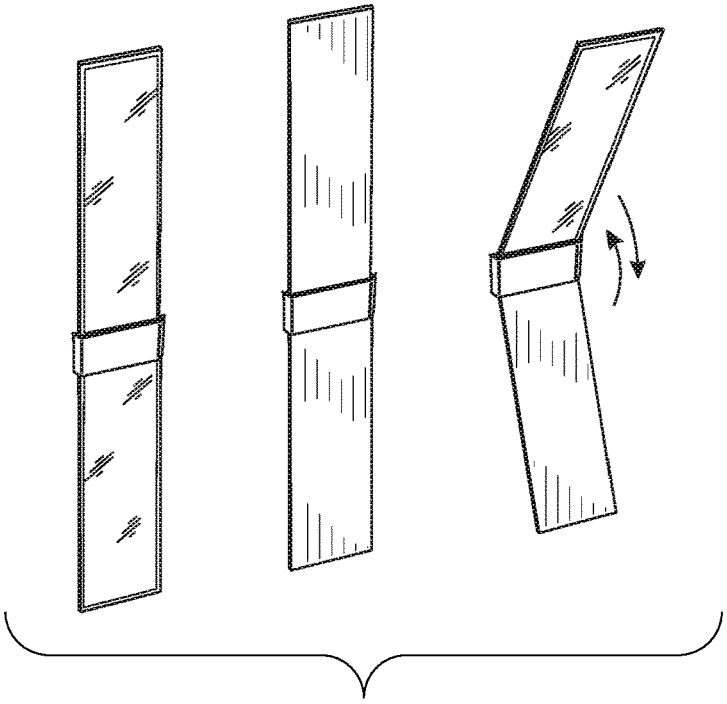
FIG. 18C

DETACHABLE ELECTRICAL CONNECTION FOR FLAT LIGHTING MODULE

CROSS-REFERENCE TO RELATED APPLICATION

This application claims priority to PCT application number PCT/US2017/019281, filed Feb. 24, 2017, which claims the priority of U.S. Provisional Application 62/300,503 filed Feb. 26, 2016; the disclosures of which are incorporated by reference herein.

BACKGROUND

LED (light-emitting diode) and OLED (organic light-emitting diode) lighting panels offer many advantages for general lighting purposes. They are efficient in terms of light output for power consumed. They are low voltage which helps avoid potential electrical shocks, less prone to sparking in potentially explosive environments and reduce loads in the supporting electrical system. The spectrum of emitted light can be varied using appropriate internal designs. They produce little or no UV or IR light. They are instant on; that is, they emit light immediately whenever electrical power is supplied.

LED light sources are inherently small point sources and in order to serve as a flat general lighting source, many separate LED devices must be ganged together. This raises manufacturing costs and complexity. Uniformity of the light surface must be controlled by appropriate design. LEDs produce some heat and so, heat sinks or other thermal control measures are often employed. Practical LED lighting panels can be made very thin, for example as thin as 3-16 mm, with appropriate system design. OLED light sources are inherently flat area light sources. They offer several advantages over LED lighting panels. They can be made even thinner (for example, less than 1 mm thick) and they produce very little heat under normal operating conditions. However, manufacturing costs are higher and lifetime can be an issue. Both LED and OLED lighting panels can be made on flexible substrates even though OLED is preferred for this application.

In summary, both LED and OLED technology can be useful as lighting panels. They are both efficient, low voltage, cool to the touch, and are thin. Luminaires (a complete unit with a light source (i.e. a lamp) and a base or support unit (i.e. containing a lampholder or fitting that supports a light source) that provides light and illumination) can be designed to utilize flat LED or OLED lighting panels.

In some designs, it would be desired to locate the lighting panel at a distal or terminal end of the luminaire. For example, a luminaire serving as a desk lamp could have a lighting panel located at the terminal end of a supporting arm anchored by a large base at the other end. The panel may be connected to the supporting arm at any non-emitting portion of the panel. It might be desirable in some designs, for aesthetic reasons, to connect the panel along one of its edges (in the same plane as the thinnest direction) as compared to the middle of the panel back (perpendicular to the thinnest direction).

One potential problem of this kind of design is that the LED or OLED panel needs to be much larger in terms of the size of the illuminating area (to provide sufficient light) relative to its thickness. Since the panel is cool to the touch, users may grab the panel which could apply directional torque and force to the connection between the thin edge of the panel and the supporting arm. For example, see the fixture shown in FIGS. 15A and 15B. Under these conditions, it is possible that an edge connection to the supporting arm could break if the connection between the thin panel and the supporting arm is not robust enough.

It would also be desirable to have the lighting panel to be easily detachable or replaceable from the remainder of the luminaire. In this way, the lighting panel may be replaced when defective or upgraded with newer panels or panels with different characteristics or attributes. For example, the lighting panel could be swapped for one of a different size, one of a different color or style, or one of a different color temperature.

Moreover, LED and OLED panels require driver or control circuitry which is typically supplied by a PCB (printed circuit board). Since the PCB can also become defective or needs to be upgraded, it would be desirable that the control circuit be located together with the LED or OLED panel in the detachable or replaceable portion of the luminaire. It is desirable that the PCB be designed specifically for a panel, so the combination of the PCB and LED or OLED lighting panel delivers a specific performance, such as a specific amount of light. Thus, when future generations of LED or OLED lighting panels with higher efficacy are available as a module, the new module will have a driver that controls the module to deliver the same performance while achieving additional energy savings. This will allow a customer to upgrade an older fixture while maintaining the lighting functionality. In other words, it would be desirable to have a lighting module comprised of at least one lighting panel, appropriate power and control circuitry and a means to make a detachable connection to the fixture base or luminaire base so that both lighting panel and control circuitry are replaced together as a single unit. This would require detachable electrical connections between the control circuitry of the lighting module and the lampholder.

In addition, it would be desirable that the connection between the detachable lighting panel module and the lampholder be reversible. That is, the detachable lighting module can be replaced in two different orientations; one in the opposite orientation from a first orientation. For example, in a wall sconce application, the lighting module could be attachable either in an orientation towards the wall for indirect lighting or an orientation out towards the room for direct lighting so that a user can adjust the lighting direction as desired without changing the lampholder position or orientation. An example of this is shown in FIGS. 18A and 18B which shows wall sconces with two different lighting modules, where one could be orientated to be indirect (orientated towards the wall), one could be direct (orientated in the opposite direction away from the wall) or where one is direct and the other indirect. Having a reversible lampholder enables customization by the user. Other examples (as shown in FIGS. 15A, 15B, 16A, 16B among others) are table lights with multiple lighting modules. The ones on the side of the fixture towards the user may be directed down toward the task work, while the one away from the user may be directed toward the wall or ceiling for indirect lighting of the room. The non-permanent electrical connections would then need to be positioned in such a way to allow for the reversibility of the connection. Note that in other designs, this reversibility feature may not be required and the system may be designed so that the lighting module would fit into the lampholder only in one single orientation.

The non-permanent electrical connections between the module and the lampholder may be required to support other functions other than supplying power, driver and control signals to the lighting panel. For example, the lighting module may contain sensors (i.e. touch sensors, ambient light sensors, occupancy sensors, sound sensors, etc.) and these signals from these sensors may also be communicated through the electrical connections for use in other parts of the lampholder or lighting fixture for purposes such as coordinating the function of multiple modules or to supply the information to other systems outside the lighting fixture. Alternatively, the sensors may be located in the lampholder or lighting fixture and the signals be sent through the detachable electrical connection to the control circuitry so that the lighting panel can be appropriately driven.

Luminaires with detachable or removable flat lighting panels are known; for example, U.S. Pat. No. 6,776,496 describes area illumination devices with OLEDs that are removably mounted in a horizontal plane. U.S. Pat. No. 6,819,036 describes area illumination devices that are removably mounted in a socket of the device. U.S. Pat. No. 6,565,231 describes area illumination devices with multiple OLEDs that are removably mounted. KR2006081277 describes OLEDs electrically and mechanically connected to a power source via a socket. U.S. Pat. No. 4,626,742 describes electroluminescent devices where the substrate has a non-luminescent area with conductive areas that can be used to form electrical connections as a plug connection. U.S. Pat. No. 7,040,910 describes electrical connectors where the male and female portions latch together in a non-permanent manner. However, none of these devices would provide a flat detachable and potentially reversible electrical connection between the thin edge of the lighting panel and the rest of the luminaire with adequate robustness while maintaining a pleasing appearance. A luminaire with a sleek appearance is shown in USD641916 (currently co-assigned). However, this design shows no details for attachment of the lighting panel.

U.S. Pat. Nos. 7,034,470 and 6,787,990 describe flat lighting panels with a tab on the thinnest edge of the panel which detachably fits into a socket. As described, the tab can only fit into the socket one way and electrical connections are made within the socket. These approaches may not provide adequate mechanical stability. US2016/0084445 describe a housing into which a flat lighting panel can be removably fitted and which provides mechanical support and electrical connection along both edges of the panel. However, while this approach may provide good mechanical support, it is not thin. US2014/0104857 describes a housing which supports flat lighting panels with a recess on the rear (non-light emitting) surface into which a socket is removably inserted to provide mechanical and electrical connection. U.S. Pat. No. 9,121,593 describes a lighting apparatus for rectangular flat lighting panels which are supported along their thinnest edges where the electrical connection is made through the back surface. U.S. Pat. No. 7,510,400 describes a spring clip assembly for mounting LEDs on a surface of a heat sink.

Thus, in luminaire designs using LED or OLED lighting panels which have a much larger illumination area relative to its thickness, where the lighting panels can be located at a terminal end of a lampholder, and are desirably connected along one of the thin edge of the panel, there is a need for a robust, reversible and detachable connection system between a lighting panel/control circuitry module and the lampholder. Importantly, for aesthetic reasons, it would be desirable that the overall connection should appear to be flat and similar in thickness to the lighting module so that there is little difference in thickness in the transition from the lighting panel to the lampholder.

SUMMARY

A thin, flat, robust, detachable, reversible (in some embodiments) electrical connection system between a lampholder and a thin edge of a LED or OLED lighting module is described, where the lighting module, whose thickness is less than its width or length, comprises a lighting panel, control circuitry for controlling the lighting panel, and electrical contact pads connected to the control circuitry, all supported at least in part by a mechanical support plate; the mechanical support plate being at least partially enclosed in a housing with a provision or opening so that light can be emitted from the lighting panel; and where the mechanical support plate includes a male mechanical support connector section that extends out from the mechanical support plate in the same plane as the thickness of the lighting module; and where the male mechanical support connector section includes means for non-permanent locking or latching of the lighting module to the lampholder; and the lampholder comprises a female mechanical connector into which the male mechanical support connector section of the lighting module engages and which includes means for non-permanent locking or latching of the male mechanical support connector section of the lighting module; and a male electrical extension that extends out from the female mechanical connector and which engages the electrical contact pads in the lighting module to supply electrical power or communication signals or both to the control circuitry when the lighting module and lampholder are connected.

In addition, the male mechanical support connector section may not be covered by the housing, and may include two wings located along the sides of a depressed channel while the female mechanical connector has two grooves configured to engage the wings of the male mechanical support section so that when the lighting module and lampholder are connected, the two wings of the male mechanical support section engage with the two corresponding grooves of the female mechanical connector; and the male electrical extension of the lampholder fits along the depressed channel of the male mechanical support section to make contact with the electrical contact pads of the lighting module. The electrical contact pads of the lighting module can be positioned over the depressed channel of the male mechanical support connector section so that the surface of the electrical contact pads aligns with the level of the wings. This allows for electrical contact to be made between the male electrical extension of the lampholder and the contact pads in two orientations when the male electrical extension is fitted within the depressed channel. Moreover, the depressed channel of the male mechanical support connector section may include one or more notches in its leading edge that engage against corresponding springs, posts, pins or vertical structures located beneath and/or above the male electrical extension of the lampholder.

Such a connection system is aesthetically pleasing, provides mechanical support to the lighting module, provides electrical connections for the control circuitry, allows for easy replacement of the lighting module, and allows connection in different orientations.

This electrical connection can be incorporated in a luminaire of various types. One example of a luminaire has a base unit, either freestanding or attached to an object, that anchors the luminaire and one or more extending arm(s), where at least one of the extending arm(s) terminates with the lampholder of the flat detachable electrical connection system. The luminaire may have extending arm(s) may contain one or more movable or adjustable joints.

This type of electrical connection is robust because the thin lighting panel is supported by a flat plate, one section of which also serves as the male connection to the lampholder. The male mechanical support connector section of the plate is rigid because it is non-planar and has a depressed channel between two wings. The bends in the male mechanical support connector section of the support plate help to prevent bending or twisting. Because of the depressed channel, there is room to fit contact structures of the power and control circuitry which provide driving of the LED or OLED panel. Because of the rigidity of the male mechanical support connector section of the plate, the electrical connections between the power and control circuitry and the lighting panel are subjected to a limited amount of stress. Because the male connection part of the plate can be made wide, it can provide support along a significant portion of the edge of the lighting module. The channels or grooves along the sides of the female connection section of the lampholder into which the wings of the male mechanical support connector section of the plate slide provide support in two different directions; laterally (preventing the lighting module from moving side-to-side in the same plane as its thickness) and up/down (preventing the lighting module from moving in a direction perpendicular to its thickness). Working together, the channels in the lampholder also transfer torques applied to the lighting module to the fixture in an efficient manner.

This type of electrical connection is detachable because the male and female sections of the connection are non-permanently locked together by cooperation between features mounted in the female section fitting into or engaging with corresponding features in the male mechanical support connector section. The engagement of these features holds the male and female parts together so that they are held together solidly and are firmly connected. However, the application of sufficient pressure will cause the features to be disengaged so that the male connection can be withdrawn.

This type of electrical connection can be reversible because the midpoint of the electrical contact structures of the control circuitry of the lighting module is aligned with the midpoint of the wings. It will not matter which way the depressed area is oriented since the male mechanical support connector is symmetrical with respect to the wings and the contact structures of the control circuitry. The flat male electrical extension from the lampholder can have electrical connections on both sides facilitating the electrical connection of the lighting module to the lampholder in either of the reversible assembly configurations. In some designs, this reversibility feature may be disabled so that the lighting module fits into the lampholder in only a single orientation.

With the features as described, the detachable electrical connection between the control circuitry and the lampholder is robust and readily manufacturable. By locating the "male" side of the electrical connection in the lampholder, the manufacturing tolerances for the electrical connector of the lampholder are reduced. Moreover, the two-way interlocking nature of the male mechanical support connector section of the mechanical support plate of the lighting module fitting into the lampholder while simultaneously, the male electrical extension of the lampholder fitting into the lighting module allows a very robust mechanical connection without placing undue mechanical stresses or tight alignment tolerance requirements on the electrical connections. This ensures good electrical connections can be maintained even when the connection between the lighting module and lampholder undergoes undesired amounts of torques and linear forces.

BRIEF DESCRIPTION OF THE DRAWINGS

FIG. 1A shows a plan view of one embodiment of a suitable long mechanical support plate design. FIG. 1B shows close-up details of the male mechanical support connector area of the mechanical support plate.

FIG. 2 shows top (2A) and front (2B) edge views of one embodiment of a suitable short mechanical support plate design.

FIG. 5 shows an example of one embodiment of the top (5A) and bottom (5B) sides of a bare lighting module (an assembled lighting module without the front and back covers or other structures).

FIGS. 15A-15B, 16A-16B, 17A-17B, 18A-18C, 19A-19B, 20A-20B, 21A-21B, 22, 23A-23B, 24, 25A-25E, 26, 27A-27C, 28A-28C, 29A-29B, 30A-30B, and 31A-31B show some examples of luminaires that utilize the flat, reversible (in some instances) and detachable electrical connection for flat lighting modules as described.

DETAILED DESCRIPTION

Figure 3:
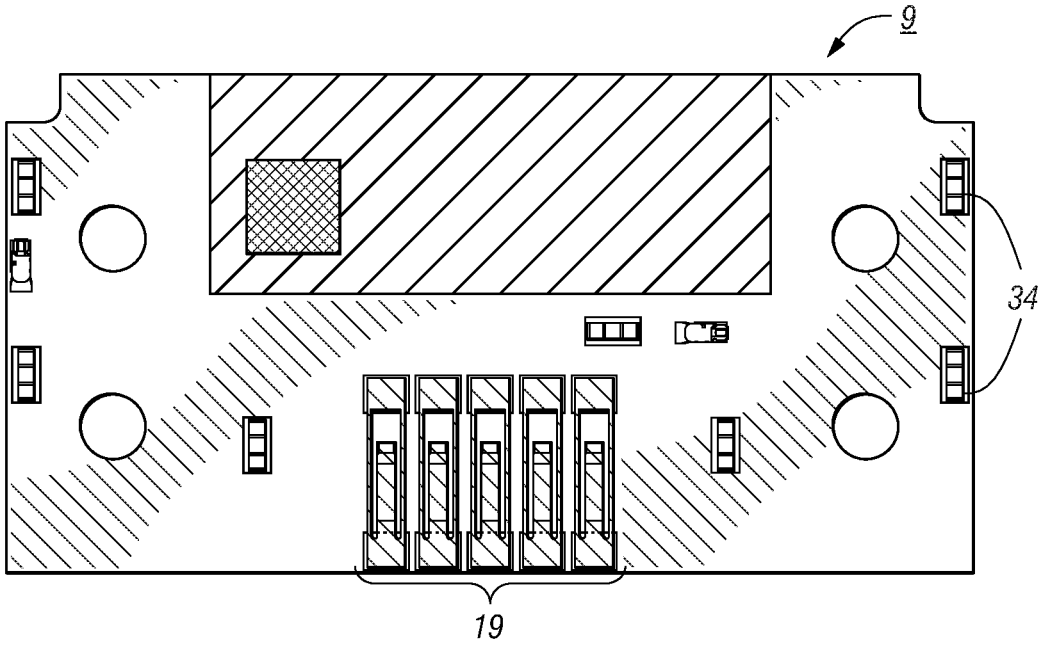
FIG. 3 shows a top view of an example of a PCB with test points used as control circuitry for the lighting panel.

As already mentioned, it is possible that an edge connection to the supporting arm could break if the connection between the thin panel and the supporting arm is not robust enough. For clarification, a robust connection includes the following attributes among others:

1) Strong enough—for example does not bend (deform permanently) or break.
2) Stiff enough—the deflections under the torques and lateral forces required to reconfigure any moveable joints in the fixture (e.g. rotate the lighting module or change the elbow joint) are small. In other words, the electrical connection between the lighting module and the remaining part of the fixture is unaffected by the forces necessary to adjust any movable parts of the remaining parts of the fixture. Moreover, any deflections that do occur within the electrical components must be small enough under these conditions that they do not result in damage (e.g. electrical traces are not broken) due to the bending.
3) Doesn't wobble or rattle when shaken. The lighting panel does not appear "loose" or sloppy when connected, but rather appears "tight" and secure.

Other desirable features, as described above, include a detachable lighting panel wherein at least a portion of the control circuitry is incorporated into the lighting panel, the orientation of the panel is reversible, and the non-permanent electrical connection includes communication features.

One distinguishing feature of this system is that the mechanical support system is "male" from the lighting module side, but the electrical connection is "male" from the lampholder side. Some of the advantages provided of having the mechanical support being provided by a male connection on the lighting module side include:

1) By having the mechanical support provided by a mechanical support plate that holds the lighting panel and the control circuitry, the male mechanical support connector section is an integral part of the structural backbone of the module with no joints inside the consumer module. This provides both structural strength and easy manufacturability.
2) By making the lighting module without internal mechanical joints, the lighting module can be kept thin, slim and sleek.
3) By using a rigid male connection that is integral to the lighting module that extends into the lampholder, the connection is robust so that any forces applied to the module during handling can be transmitted to the lampholder without breaking or irreversibly bending of any of the component parts.
4) The supporting mechanical support plate has a depressed channel that not only provides rigidity, but also allows space to allow for the male electrical connection of the lampholder to contact structures of the control circuitry for the lighting panel within the module.
5) The male mechanical support section can be made wide to provide support against twisting or torqueing of the lighting module when mounted in the lampholder.
6) A mechanical support plate with the appropriate features can be easily manufactured to the required mechanical tolerances, robustness and ease to use. If the fit with the lampholder is "too precise" then insertion will be difficult and yields of manufactured parts will be low. Yet "precision" is required for a good feel—e.g. a firm connection where parts are held solidly together and don't wobble or rattle or shake apart.

Figure 11A:
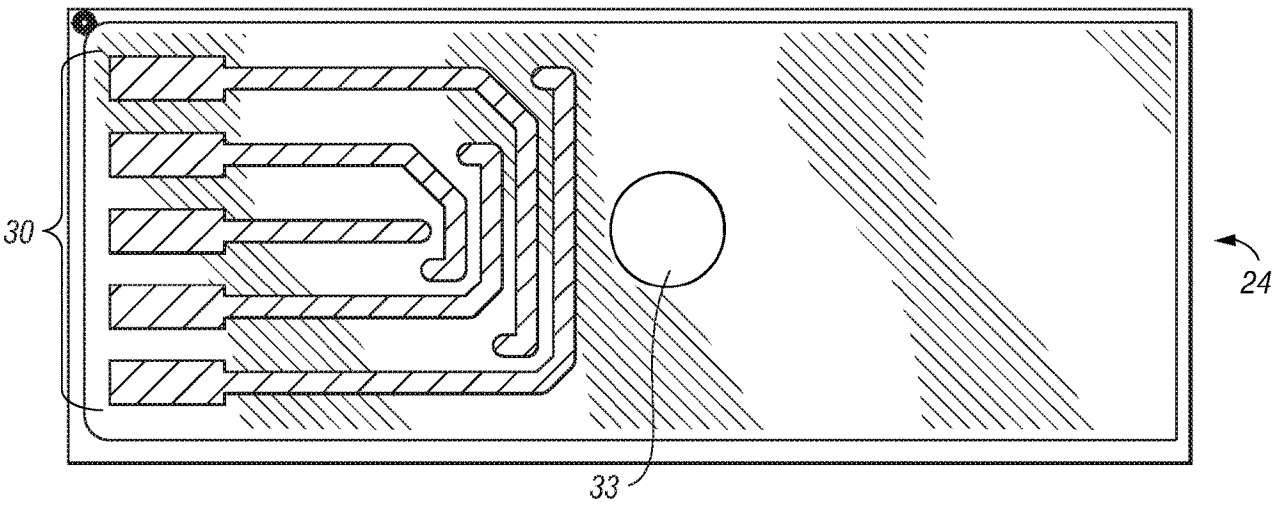
FIGS. 11A-11B show top and bottom views, respectively, of an embodiment of the male electrical extension part of the lampholder connector. The electrical connections of the male electrical extension to the rest of the lampholder have been omitted for clarity.
Figure 11B:
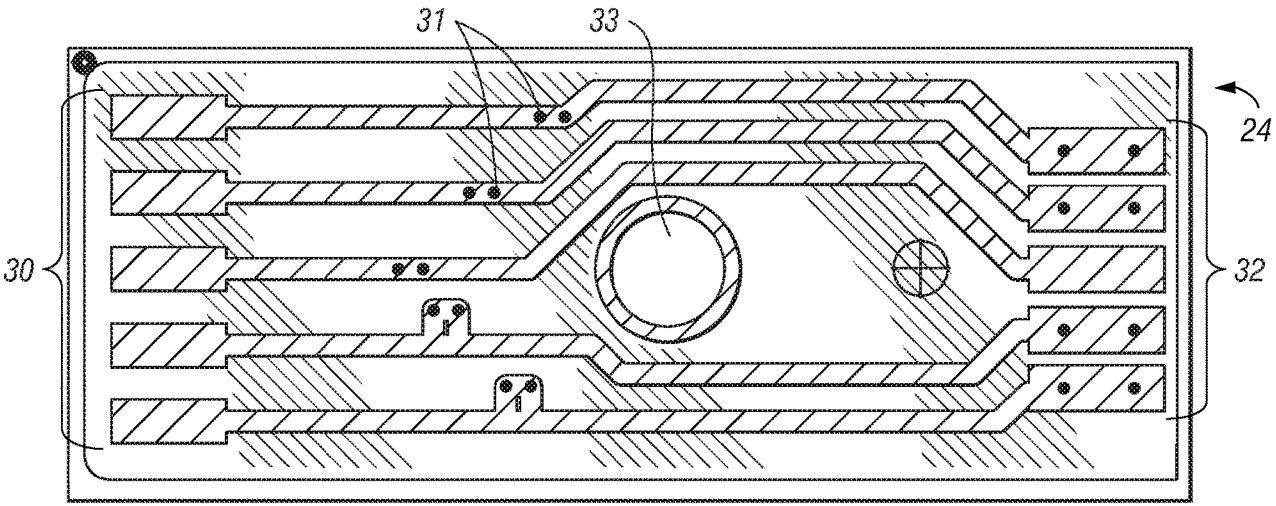

Some of the advantages provided of having the electrical connection being provided by a male connection on the lampholder side include:

1) The male electrical extension of the lampholder can have wide manufacturing tolerances and so, reduces the costs and increases the manufacturability associated with the lampholder. The parts requiring higher tolerance in fabrication and assembly are in the lighting module, the manufacture of which can be centralized and thus quality can be assured. The lampholder manufacturing may be done by the lighting fixture makers, which is a highly distributed industry. This design will enable rapid module-system adoption and growth by proving low barriers to entry to fixture maker (e.g. low lampholder costs and wide tolerances) while assuring quality through control points in the centralized lighting module manufacturing process.
2) By using a low-cost PCB (for example, a PCB with no active circuitry) with electrical contact pads on both sides for the male electrical extension of the lampholder which fits inside the depressed channel, this design enables a very low-cost and robust way to provide the reversibility feature for making a reversible electrical connection between the lighting module and the lampholder. For example, if the electrical extension has electrical contacts on both sides (as shown in FIGS. 11A and 11B), then only one set of electrical contacts is required resulting in a low-cost way to support the reversibility function.
3) The lampholder can easily be designed to support the male electrical extension in alignment with the side grooves (i.e. 22 in FIG. 12A) for the wings (i.e. 5 in FIGS. 1A and 1B) for a simple low-cost system. To design this support and alignment on the module side would require additional mechanical support structures and electrical connection structures, which would add to the cost of the system.
4) The use of a male electrical extension on the lampholder side to make electrical connection to the control circuitry via contact pads in the lighting module in which the pad surfaces are aligned with the level of the wings is a system design that is low-cost, reversible, and also independent of the channel depth in the male mechanical design on the module side. Thus, smaller modules, which will have thinner module thicknesses since less mechanical support of the lighting panel is needed, can also have shallower channels in the mechanical interconnection area. Similarly, larger or longer modules that require more mechanical support, can have deeper channels to achieve this support. This design allows both the small and large modules to fit into the same base in spite of the different channel depths, enabling interchanging of modules in a fixture base depending on the application, while using the same lampholder design, and even fixture base or luminaire base design.

Some of the features of the flat lighting module and the lampholder along with some details of the detachable mechanical and electrical connection between them will now be described.

LED (light-emitting diode) and OLED (organic light-emitting diode) lighting panels are available in different shapes, sizes and thicknesses on their own substrate. For example, such lighting panels can be rectangular (including rectangles with rounded corners or edges), square, round, oval or triangular. The size used is generally large enough to provide a sufficient amount of light for the design needs. If the design requires more light than can be provided by a single panel, multiple lighting panels, wired in either series or parallel and with one single controller or with individual controllers, can be used. The panels can emit white light of any color temperature or in some examples such as automotive taillights, can emit colored light.

In general, LED and OLED lighting panels have an emitting surface area with a length and width whose dimensions far exceed its thickness. For example, the thickness of the lighting panel will generally be in the order of 20 mm or less making it the thinnest edge, while the length and width will typically be greater than 10 cm or more. This means that the lighting panels, along with the lighting module which contains the lighting panels, will have an edge dimension that is much thinner than either the length or width of the surface. Desirably, the ratio of the thickness to the surface area of a flat lighting module will be at least 1:20 or greater or more desirably, at least 1:50 or greater. It is an important feature that the mechanical and electrical connections from the module to the lampholder are made through this thinnest (least thick) edge of the module as opposed to the back or front surfaces of the module. The connection of the flat lighting module to the lampholder will be in the same plane as the thickness of the lighting module.

The term "flat", as applied to the lighting panel or lighting module, means that the thickness dimension is less than any of the dimensions of the surface. In this regard, "flat" does not imply that the surface of the lighting panel or module is entirely smooth, or that the lighting panel or module is non-reflective, or that the lighting panel or module is not curved or bent. A lighting panel or module can have a very rough and bumpy surface, or a non-reflective black surface, or be curved and yet still be a flat lighting panel or module if its thickness is less than its length and width. Likewise, "flat" in regards to the electrical connection system, which comprises the connected flat lighting module and the lampholder, also means that when connected, the thickness dimension of the connected parts is less than any of the dimensions of the surface. Desirably, the ratio of the thickness to the surface area of a flat electrical connection system will be at least 1:20 or greater or more desirably, at least 1:50 or greater The lighting panel requires control circuitry to provide the desired amount of current and other control functions (for example, on/off switching, short or temperature detection, receiving and execution of command signals, changing color, etc.). In some examples, the control circuitry is located on the same substrate as the lighting panel so that is integral to the lighting panel. In other examples, the control or driving circuitry is provided by a separate PCB (printed circuit board) where the circuits are mounted on their own substrate. A thin PCB can be mounted directly on the front or back surfaces of the mechanical support plate without significantly increasing the thickness of the module. If mounted on the same side of the plate as the lighting panel, the PCB can be located to the side of the lighting panel in the same general plane so their surfaces are parallel in order to minimize the overall thickness of the lighting module. If the PCB is located on the opposite side of the mechanical support plate to the lighting panel, it can overlap with the lighting panel entirely or in part.

There are permanent electrical connections between the control circuitry and the lighting panel. These connections can take any form. If the PCB containing the control circuitry is located on the opposite side of the mechanical support plate from the lighting panel, the PCB can electrically contact the lighting panel (using contact pads on its non-emitting side) directly through suitable openings in the mechanical support plate using, as one example, spring type contacts on the PCB, thus eliminating the need to solder connecting wires or other connectors. This embodiment is facilitated because the relatively large surface area of the driver PCB allows it to be structurally attached to the rest of the mechanical structure using adhesive and to resist the spring force created by the electrical contacts.

Both the lighting panel and the control circuitry are mounted to the same mechanical support plate. The mechanical support plate is desirably metal, but could be made of polymeric materials if sufficiently rigid at the desired thickness. It can also be made of hybrid or laminated materials if sufficiently rigid. For example, a suitable flat polymeric plate could be prepared from polymeric materials stiffened with internal metal support structures where the polymeric material would not have sufficient rigidity at the same thickness without the metal support structures. If made of metal, the plate can have plastic molded on its surfaces to give a low-cost means for aligning or attaching parts such as the lighting panel, the driver PCB, the back cover, or the front housing or bezel. In general, the mechanical plate is separate from the substrate of the lighting panel although it would be possible to manufacture a LED or OLED panel directly on the plate as a substrate. The lighting panel and control circuitry can be attached to the mechanical plate by any appropriate fastening means such as adhesives such as glue or tape, magnetism or mechanical means such as screws. It is also possible to attach either the lighting panel or control circuitry or both to the mechanical plate by a non-permanent snap-fit method where the components are held in place by pressure devices such as clips or retaining springs, possibly in conjunction with other features in the mechanical plate.

FIG. 1A shows one example of a mechanical support plate 1 which is made of metal. It has two sections: a lighting panel support area 2 and a male mechanical support connector section 3. The male mechanical support connector 3 has a depressed U-shaped channel 4 with wing structures 5 located on both sides of the channel area 4. FIG. 1B shows a close up view of the male mechanical support connector section 3. Note that in this embodiment, the main support area 2 is long enough to fully support the entire length of a lighting module and has holes to reduce weight and well as provide connections to the lighting panel and other components of the lighting module. Moreover, note that this embodiment also shows holes 6 in the wings 5 that will engage with corresponding features in the lampholder to form a non-permanent connection. In some embodiments, it is desirable that the mechanical support plate is larger than the lighting panel so that the entire lighting panel is supported. In the case of multiple lighting panels on a single mechanical support plate, all panels would be fully supported While it is desirable that the mechanical plate is larger and/or longer than the lighting panel so that the lighting panel is fully supported (e.g. FIG. 1A), in some cases, the mechanical plate may not support the entire lighting panel. For example, a rectangular lighting panel that is approximately 45×220 mm would be fully supported by a mechanical plate that is at least 70×260 cm but it is also possible that the mechanical plate could also be only 110 mm long so that only half of the length of the lighting panel would be directly supported. In such cases, the remaining length of the panel could be supported by an extension of the mechanical plate made of a lighter material such as plastic. An example of a short (relative to the lighting panel) mechanical support plate 1 is shown in FIGS. 2A-2B. As with the longer mechanical support plate of FIG. 1, there is a support area 2 and a male mechanical support connector section 3. In this case, the length of the support area 2 is significantly less than the lighting panel. In this particular embodiment, the male mechanical support connector section 3 has a depressed U-shaped channel 4 with wings 5 on both sides of the channel and holes 6 (as shown in FIGS. 1A-1B) but additionally has a notch 18 in the leading edge 40 of the male mechanical support connector section. In addition, there are features such as holes in the support area 2 that allow for firm connection to an extension of the support plate. In some embodiments, it is desirable that the mechanical support plate is smaller than the lighting panel so that the lighting panel is only partially supported. In the case of multiple lighting panels being on one short mechanical support plate, it is only necessary that at least one lighting panel be partially supported; the remainder of the at least lighting panels and rest of the lighting panels can be supported by the extension of the mechanical support plate.

The extension of the different support material is attached at least to the end of the mechanical plate opposite from the male mechanical support connector section and can also partially envelope the mechanical plate by an overmolding process. The use of an overmolded plastic extension to support the remainder of the lighting panel not supported by the short mechanical support plate can be seen as extension 10 in FIG. 6B. By "overmolded" it is meant that the plastic extension overlaps at least partially the mechanical support plate. For example, the molding process that forms the plastic extension includes part of the mechanical support plate so that the two become one integral piece. It would also be possible that the front and/or back housing may at least in part help to support that part of the module not directly supported by the mechanical plate. These alternatives would reduce the overall weight of the module while still preventing adequate support to the lighting panel.

Moreover, it is not necessary that the shape of the mechanical plate correspond to the shape of the lighting panel. For example, the lighting panel could be rectangular, but the mechanical plate could be square.

There could be multiple lighting panels included on a single mechanical plate. When multiple lighting panels are present, they could be mounted side-by-side on one surface of the mechanical plate or mounted on opposite surfaces of the mechanical plate.

In some embodiments, the mechanical plate may have an interior hole or cut-out over which the lighting panel is located. In this case, only the edge portions of the panel are supported and light from the panel can pass through the hole or cut-out portion of the mechanical plate. If the lighting panel emits light from both sides, this would allow for two opposite directions of light emission.

In the male mechanical support connector section of the mechanical support plate, there is a depressed channel region 4 between two wings 5 on either side of the depressed channel. Both wings generally lie in or near the midpoint plane of the completed lighting module in the thickness direction with the bottom of the depressed channel lying out of plane with the wings, however, designs with other offsets are also possible. The depressed channel has a relatively flat bottom with a transition region (e.g. transition region 60 in FIG. 2B) from the bottom to the wings. The degree of transition from the bottom of the channel to the wings is not critical; it may be abrupt so that the walls in the transition regions are perpendicular to the bottom or they may be gradual so the angle of the walls in the transition regions are >90 degrees. In cross section, e.g. FIG. 2B, the male mechanical support connector section plate should appear as a U-shaped channel with flat wings at the top of the U. The depressed area may only be in the male mechanical support connector section or may extend any distance towards the opposite end of the mechanical support plate. The depressed area is typically created by stamping, rolling, molding or pressing (with or without heating) the depression into a flat plate, but other processes can be applied. The depth of the depression can depend on the size and shape of the module, and the intended service of the module and the expected forces in that application. In some systems, multiple depressed areas may be desirable for additional support of the module.

There are contact structures (electrical contact pads) electrically connected to control circuitry for the lighting panel which are positioned over the depressed channel of the male mechanical support connector section so that the surface of the electrical contact pads aligns with the level of the wings. The "level of the wings" is an imaginary centerline drawn between the wings 5 over the depressed channel. These electrical contact pads allow for non-permanent electrical connections. Since the region above the depressed channel in the connected state will contain electrical connections, it may be necessary to put electrically insulating or non-conductive structures over the interior surface (that is, towards the electrical connections) of the mechanical support plate (if made of conducting metal) to prevent short circuits while connected or being connected. The insulating structures may be over the entire surface of the mechanical support plate, just over the depressed and transition regions or just over all or part of the depressed channel. The insulating structures may be applied to the mechanical support plate (as for example, a non-conducting plastic tape) or may be integral to the mechanical support plate (as for example, a sprayed-on plastic coating). It may be permanent or removable.

One alternative method of supplying power and/or signals to the control circuitry of the lighting panel in a non-permanent manner would be to supply electrical conductive leads or wires from the control circuitry that would extend along the male mechanical support connector section that terminate with electrical contact structures. These electrical contact structures at or near the end of the male mechanical support connector section would make electrical contact with corresponding electrical contact structures located within the lampholder when the male mechanical support connector section is inserted into female mechanical connector of the lampholder. Separation of the male mechanical support connector section and the lampholder would then disengage the electrical contact. For example, at least two separate conductive leads, each attached to the control circuitry of the lighting panel, could be located along the surface of the male mechanical support connector section. These conductive leads could be made of thin metal layers that are electrically insulated from the male mechanical support connector section (if made of metal). They may be located on the same surface (top or bottom) of the male mechanical support connector section, be located on both surfaces or one lead made be on one surface and the other on the opposite surface. They could be located along the wings or in the depressed channel. The contact structures located at the end of these conductive leads could be flat pads or spring type contacts. The corresponding electrical contact pads located within the lampholder would be positioned to engage with the contact structures located on the male mechanical support connector section.

A mechanical support plate may be made of steel or aluminum with a thickness in the range of 0.3 to 5 mm, preferably 0.4 to 0.8 mm. Typically, the offset of the mechanical plate in the depressed channel between the wings should be in the range of 0.1 to 5 mm, preferably 0.4 to 3 mm. The ratio of the width of the depressed channel to the total width of the metal part extending from the module should be in the range of 0.05 to 0.9, preferably 0.2 to 0.5. However, these dimensions are not limiting and may be larger or smaller if necessary. While the thickness of the wings and/or the depressed channel are typically the same as the remainder of the mechanical support plate, this is not necessary and they may be different as desired.

The male mechanical connector section of the mechanical plate that fits into the female connector of the lampholder has means that allow for non-permanent engaging, locking or latching of the lighting module to the lampholder. The female connector part of the lampholder has corresponding means that engage the means of the mechanical plate to form the non-permanent lock. Such engaging, locking or latching features include, but are not limited to, deformable prongs, pins, posts, springs, magnets, arms, holes, notches, bumps or depressions. These features can be of any appropriate size or depth and the edges of the features may be sharp or rounded. The non-permanent engaging, locking or latching means in the male mechanical support connector section and in the female lampholder connector should cooperatively engage or interact together to hold the two connectors together. The engagement of the means that hold the lighting module and lampholder together is not permanent and the means can be disengaged by the application of sufficient pressure. That is, the lighting module and lampholder are detachable (can be made separate) from each other when connected together. For example, in FIG. 12A, springs 26 in the top plate 25 of the female lampholder connector 20 non-permanently engage the holes 6 in the wings 5 of the male mechanical support section 3 as shown in FIG. 12C. Supplying pressure in the opposite direction will disengage the springs 26 from the holes 6 so that the lighting module 11 and the lampholder 20 are detached from each other.

The engaging, locking or latching features of the mechanical plate may be located on the wings 5 or in the depressed channel 4 or both. If the engaging features of the metal plate extend above the surface of the mechanical support plate 1, they are desirably located on the wings so they do not interfere with the male electrical extension (e.g. 24 in FIG. 12A) of the lampholder (where the male electrical extension fits inside the depressed channel into the lighting module when the connection is made). These features may lie along the edge of the wings 5 which slide into the side grooves of the female part of the lampholder so they engage corresponding latching features within the side grooves. Alternatively, they can be spaced away from the edge of the wings that slide into the side grooves and engage the engaging means that are located on top or bottom (or both) surfaces of the female connection section of the lampholder.

Any engaging or latching features on the inside of the depressed channel 4 should not extend above the surface of the depressed channel so it does not interfere with the sliding male electrical extension 24 of the lampholder. For example, the male mechanical support connector section 3 may have one or more notches 18 in the leading edge of the depressed channel that engage against corresponding springs, posts, pins or vertical (perpendicular to the top and bottom plates) structures located beneath and/or above the male electrical extension 24 of the lampholder. A notch/post combination of this type would reduce or prevent side-to-side motion or waggle of the connection but would not prevent withdrawal of the lighting module. A notch/post feature would also provide a positive alignment feature. For example, in FIGS. 12A and 12C, see notch 18 in the leading edge 40 of the depressed channel in FIG. 12A engaging the vertical post structure 23 when the lighting module 11 and lampholder 20 are connected.

These different types of non-permanent locking or latching features may be combined in any combination. For example, an embodiment could have holes in the wings along with notches in the leading edge of the male mechanical support connector section to engage with corresponding springs and posts in the female mechanical connector of the lampholder.

If the control circuitry of the lighting module is a PCB, which may be as thick or thicker than the lighting panel, it could be located, all or in part, within or over the depressed channel. The PCB may contain electrical contact pads for connection directly on the PCB. In particular, the surface of the contact structures of the PCB in the thickness direction should align (approximately) with an imaginary line connecting the plane of centerline of the two wing sections (the level of the wings). Alternatively, a single thin PCB with driver circuits could have contact structures in one area for making electrical connection to the male electrical extension in the lampholder, and overlap the lighting panel in another area with contact structures for making electrical connection to contact pads on the non-light-emitting side of lighting panel. This embodiment uses a single PCB in the module, and allows low-cost assembly without soldering.

This central alignment of surface of the electrical contact pads of the control circuitry will allow for the connection to be made in opposite directions: either with the depressed channel above the plane of the wings or with the depressed channel below the plane of the wings. In either of these orientations, the surface of the electrical contact pads remains in the same relative position. Likewise, in either orientation, the male electrical extension part of the lampholder, which has its own electrical contact structures, can fit inside and slides along within the depressed channel to make contact with the electrical contact pads of the lighting module.

For embodiments where the control circuits are an integral part of the lighting panel and are located on the same substrate as the LED or OLED functionalities, the control circuitry should be at least partially located over the depressed channel and there should be electrical contact pads that extend from the control circuitry to (approximately) the imaginary line connecting the plane of the centerline of two wings. As above, this will allow for the metal plate to be connected in opposite orientations while still making robust electrical connection with the male electrical extension of the lampholder.

The control circuitry within the lighting module needs to make a non-permanent electrical connection with the male electrical extension section of the lampholder. In some embodiments using a PCB as the control circuitry, the electrical contact pads are located directly on the edge of the PCB which butt into corresponding electrical contact structures on the male electrical extension of the lampholder. In other embodiments, there are electrical contact pads on the top and/or bottom surfaces of the PCB. In this embodiment, the electrical contact structures of the male electrical extension of the lampholder make contact with the PCB contact structures as the male extension slides under or above the PCB. The design or size of electrical contact pads used in either lighting module or male electrical extension is not critical and is a matter of design. Some examples of suitable electrical contacts pads are flat structures that slide into contact or spring-like or flexible pads which press against either a flat pad or another flexible pad.

Figure 4:
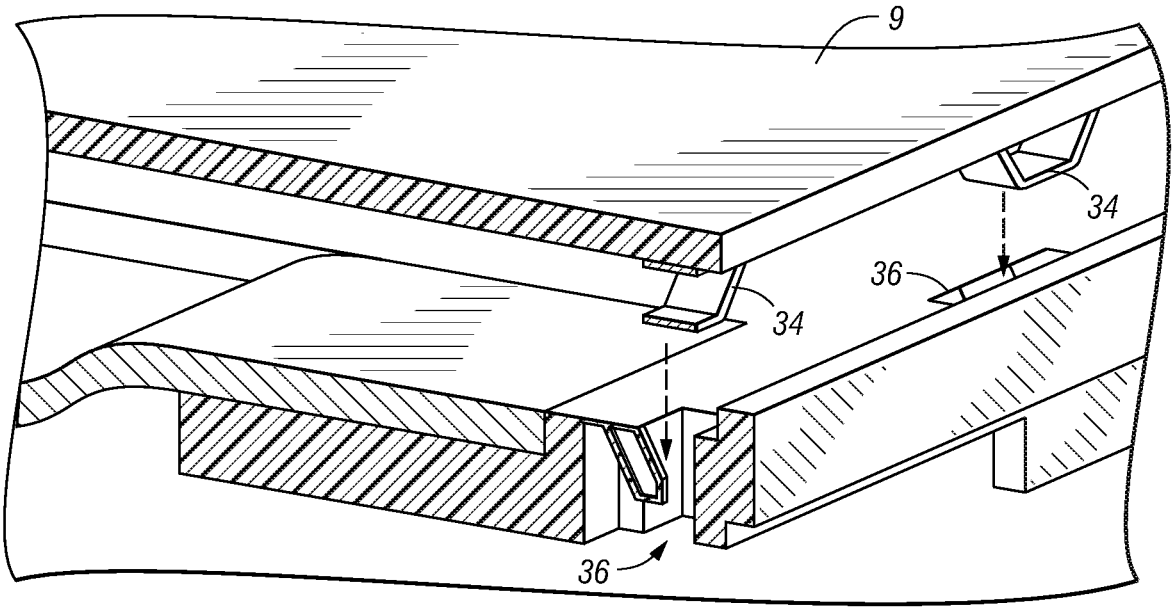
FIG. 4 illustrates one snap-in method of attaching the PCB to the mechanical support plate.

For example, FIG. 3 shows a typical example of a suitable PCB with contact pads 19 located along one end. These pads will eventually make contact with the electrical contact pads located on the male electrical extension of the lampholder when the connection is made. FIG. 4 illustrates one snap-in method of attaching the PCB to the mechanical support plate by the use of test points 34 on the PCB that fit into slots and hold-down deformable fingers in the mechanical support plate.

The flat lighting module comprises in part at least the elements of a lighting panel, control circuitry, and an electrical contact pads, all supported by a mechanical support plate structure which is at least partially enclosed within a housing. Without the housing, this will be referred to as a bare lighting module. This is illustrated in FIGS. 5A-5B where the bare lighting module 7 has a short mechanical support plate 2 with a lighting panel 8 on one side which is supported by a short mechanical plate 1 (not fully visible) along with an overmolded plastic extension 10. On the back side, there is a PCB 9. The male mechanical connector section 3 extends from one thin edge of the bare lighting module.

The bare lighting module may be enclosed in a housing with a provision or opening so that light can be emitted from the lighting panel, which will be referred to as a complete lighting module. The housing may be made of plastic or metal. It may have decorative features or attached trim. There may be filters or semi-transparent diffusing screens that are located over the light emitting areas. While it may be a single integral unit, the housing may be formed of multiple pieces such as a front and back cover plate which are fitted around the internal components of the module. For example, in FIG. 6B, the back cover 12 and the front cover 17 together form the housing. The housing may also extend past the end of the male mechanical support connector section so long as it does not interfere with the connection with the lampholder. However, in many embodiments, it is desirable that the male mechanical support connector section is not covered by the housing.

As described above, the male mechanical support connector section with a depressed U-shaped channel will extend out from bare lighting module (in many embodiments, it will extend out of the external housing of the completed lighting module as well) to serve as the male mechanical support connection to the lampholder. For rectangular light modules, the male mechanical support connector section can be located either on the short edge or the long edge. Desirably, there will only be one male mechanical support connector section per edge of lighting module. However, in some embodiments, the mechanical support plate may include at least two male mechanical support sections. Desirably, the two or more male sections are located along a single edge to provide extra stability for very wide lighting modules.

It is also possible that series of lighting modules can be connected together using multiple detachable electrical connections as described. For example, a rectangular lighting module may have a male mechanical support connection on one short side (to plug into the lampholder) and another lampholder connection on the opposite short side for another lighting module to plug into with its male mechanical support connector. Alternatively, other lighting modules using different types of electrical connections or different types of mechanical connections can be connected in series with the lighting module with the detachable electrical connection as described. In embodiments where the lighting module does not need an electrical connection through the lampholder (for example, the lighting module is powered by an internal battery or another lampholder connection), the lampholder may only supply mechanical support for the lighting module.

The ratio of the width of the male mechanical support connector section of the lighting module to the overall width of the lighting module should be in the range of 0.1 to 2, preferably 0.25 to 1. In absolute terms, it is desirable that the width should be at least 25 mm or more. The ratio of the length of the male mechanical support connection to the length of the lighting module should be in the range of 0.02 to 0.5, preferably 0.03 to 0.2. In absolute terms, the length should desirably be at least 10 mm or more. However, these dimensions are not limiting and may be larger or smaller if necessary.

The lighting module may optionally contain other components besides the lighting panel, control circuitry, mechanical support plate and housing. These include, but are not limited to, internal frames or other support structures, internal permanent electrical connections, batteries or internal power sources, induction loops for receiving wireless signals, magnets, space filling structures to avoid empty internal spaces and adhesives or tapes of various types to help immobilize the internal structures.

Since LED panels, and to a lesser extent OLED panels, generate heat and/or can be prone to localized hot spots, it can be advantageous for the lighting module to contain features that help to control or dissipate heat. These heat management features can be due to physical structures such as fins, corrugated surfaces, heat sinks and the like or be due to appropriate choice of materials such as use of metals with high thermal conductivity and the like. For example, the mechanical support plate of the lighting module may contain additional structures specifically for thermal control or be made of a metal of sufficient thermal conductivity to dissipate the heat generated by the panel. Likewise, features on the other components of the module such as the housing or cover plate or internal holding frames, if present, may also serve a thermal management function.

Figure 6A:
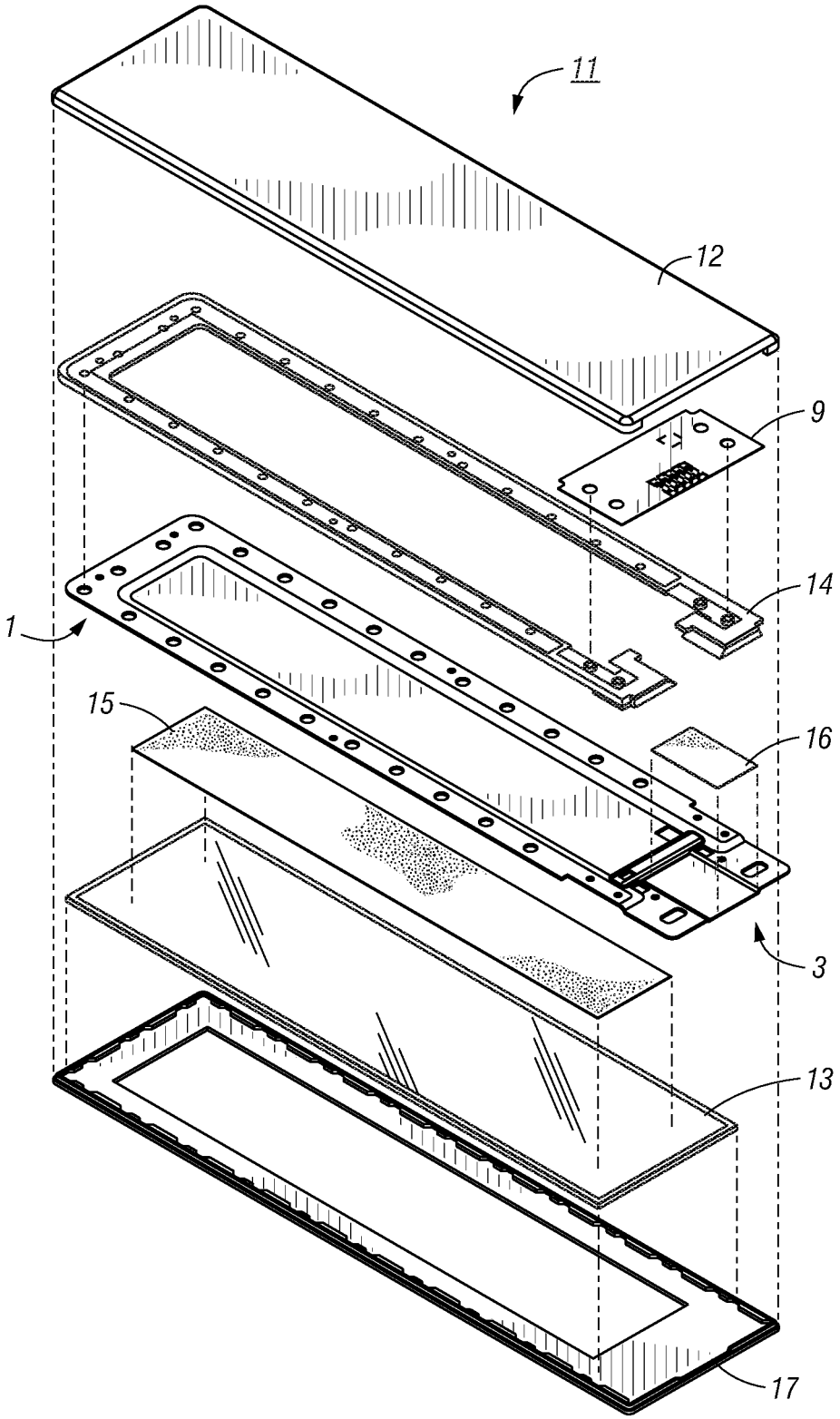
FIG. 6A shows an exploded view of an assembled lighting module with a long mechanical support plate.
Figure 6B:
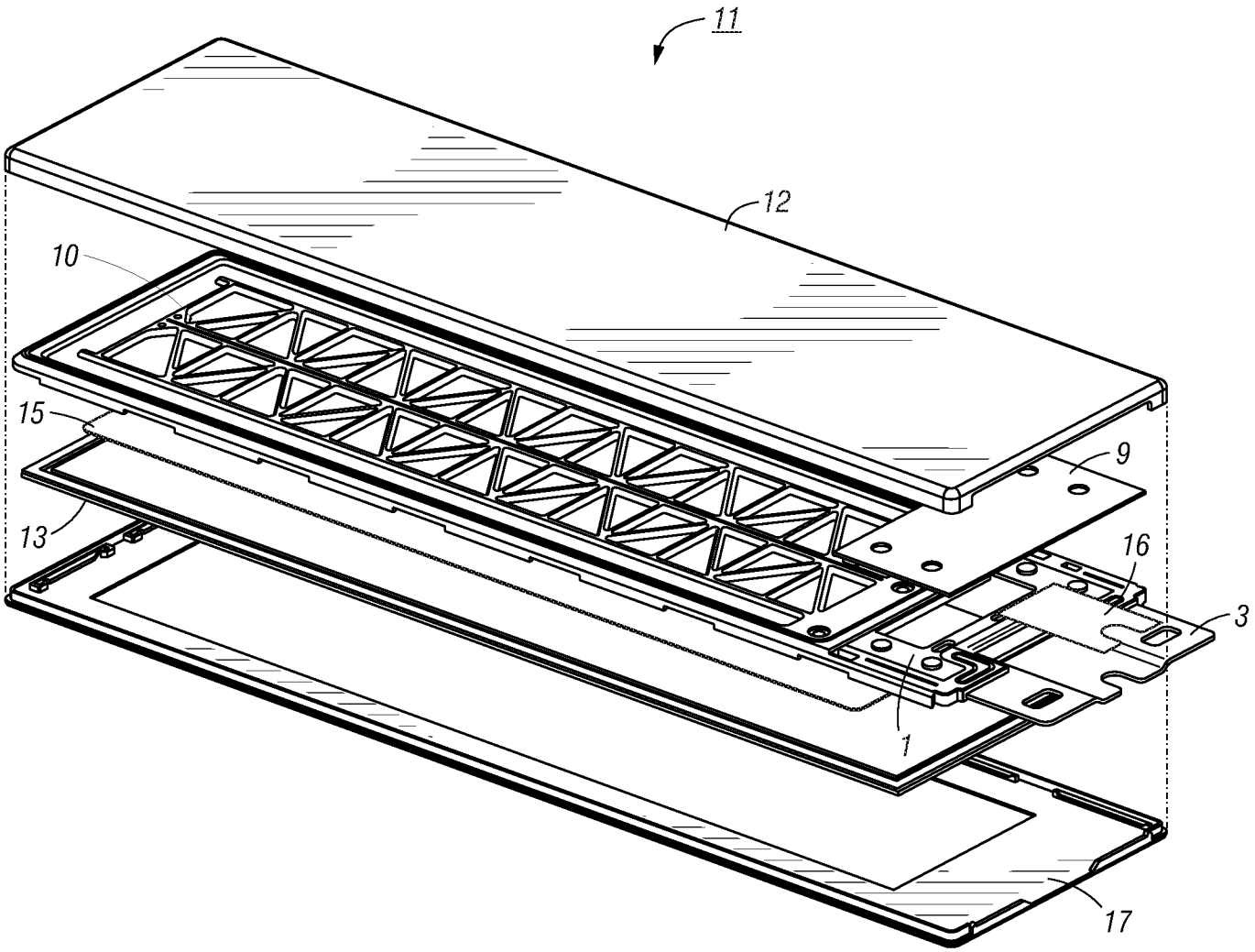
FIG. 6B shows an exploded view of an assembled lighting module with a short mechanical support plate. For clarity, internal wiring is not shown.
Figure 7A:
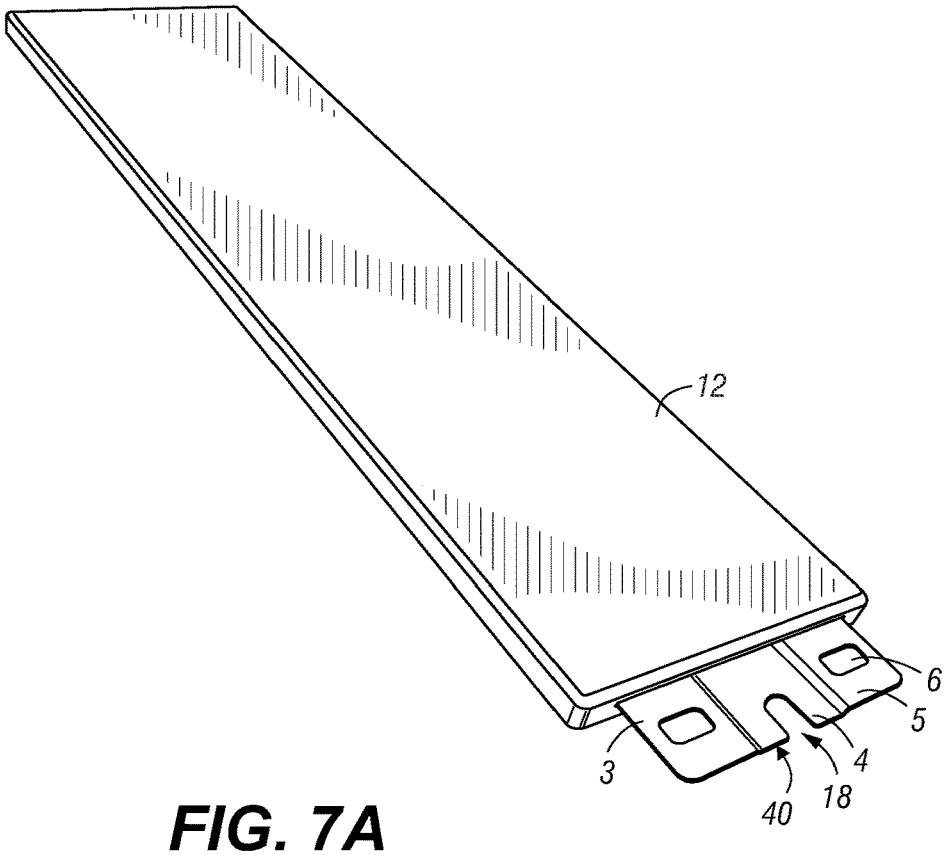
FIGS. 7A-7E show different perspective views of some embodiments of a complete flat lighting module.
Figure 7B:
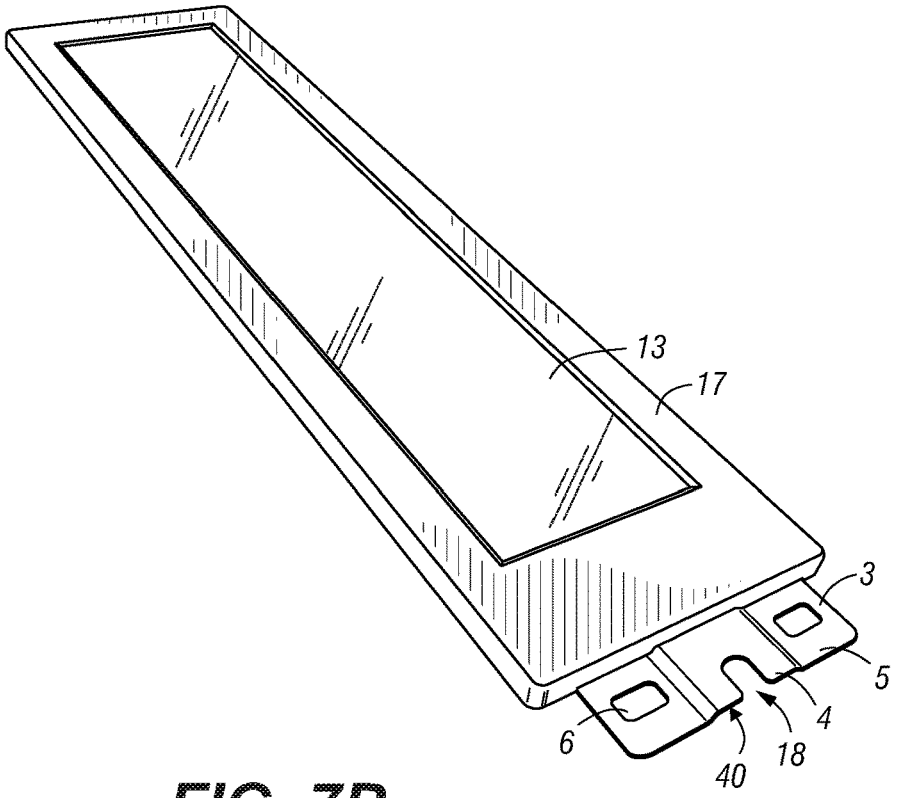
Figure 7C:
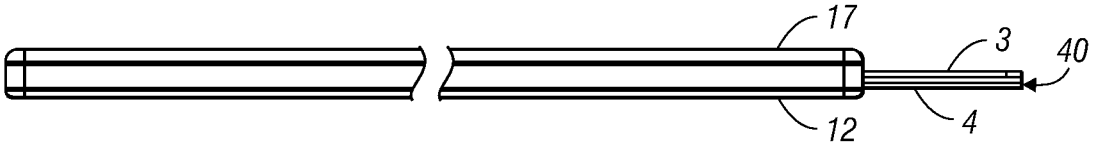
Figure 7D:
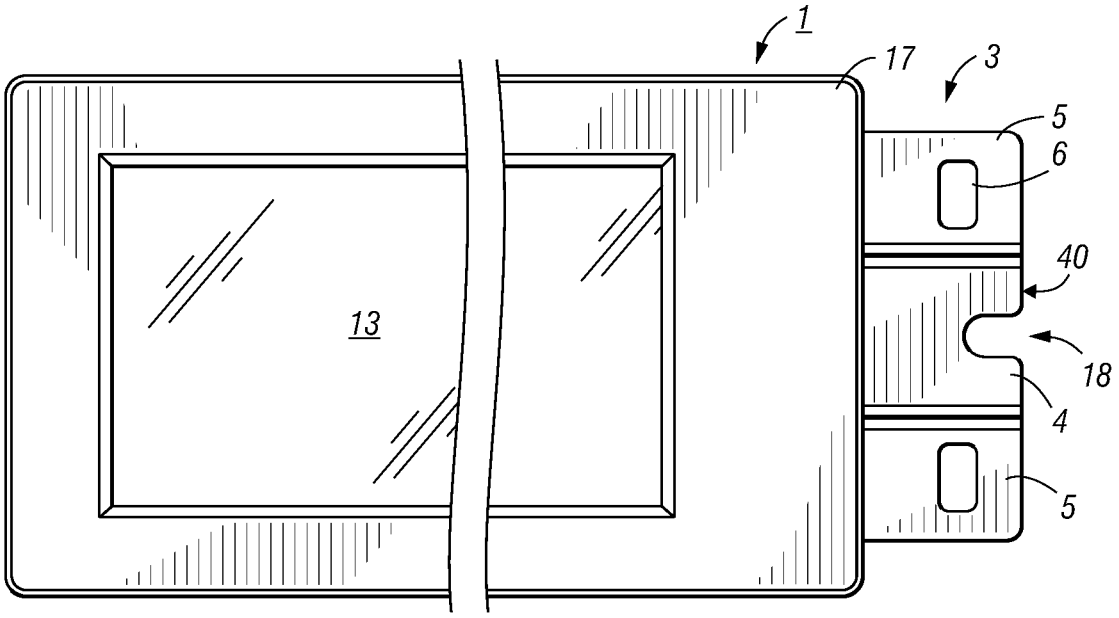
Figure 7E:
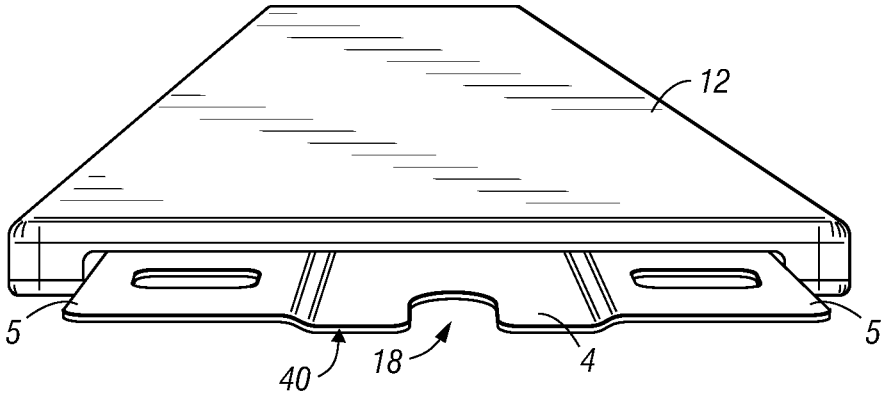

One embodiment of a complete lighting module 11 is shown in exploded view in FIG. 6A. There is a solid back cover plate 12, the lighting panel 13, an internal molded internal holding frame 14, a long metal mechanical support plate 1 with a male mechanical support connector 3 at one end, a front cover plate 17 with an opening for light emission, a PCB 9 serving as control circuitry for the lighting panel, adhesive tape 15 for attaching the lighting panel to the mechanical support plate 1 and insulation tape 16 for insulating the metal channel so that the male electrical extension of the lampholder (not shown) does not short. Internal electrical connections are not shown for clarity. FIG. 6B shows another embodiment of a complete light module 11. In FIG. 6B, support is provided by a short mechanical support plate 1 with an overmolded plastic extension 10.

FIGS. 7A-7E show examples of different complete lighting modules in different orientations. In each view, note that the male mechanical support connector section extends out from the housing on the thinnest edge of the module. Moreover, the design of the lighting module can be such that the thickness of the module is uniform everywhere (as shown in FIGS. 7A-7E). It is also possible to design the lighting module to be thicker at the connection area or the area containing the control circuitry, and thinner over the other areas of the module.

Figure 8A:
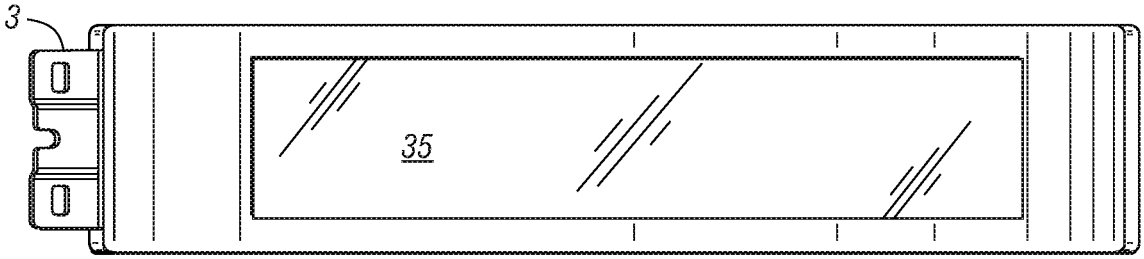
FIGS. 8A-8B and 8C-8D show examples of curved lighting modules with two possible locations for the male mechanical connector.
Figure 8B:
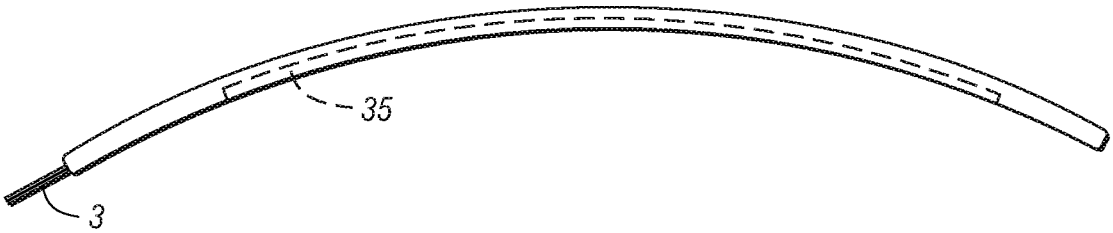
Figure 8C:
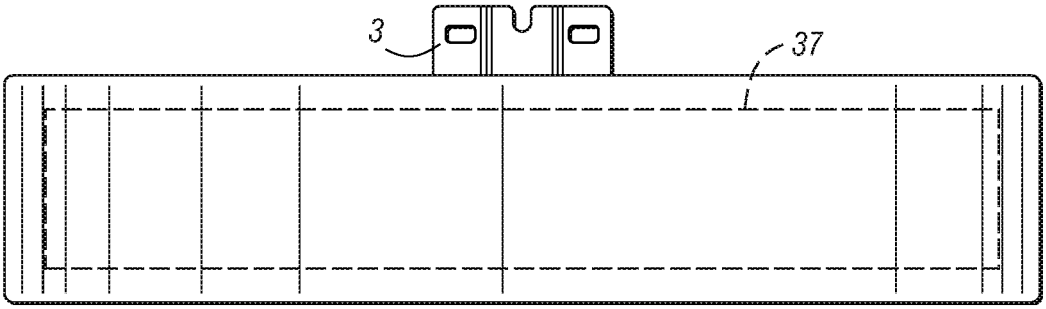
Figure 8D:
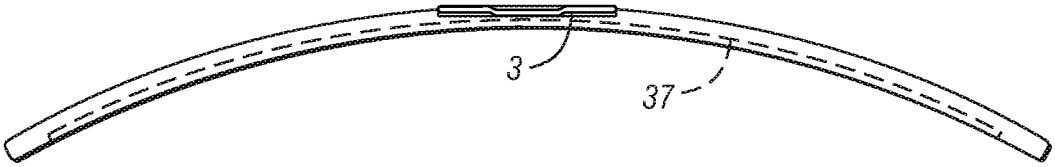

In some embodiments, a curved or flexible lighting panel can be used with a curved mechanical support plate. This results in a thin, stiff curved lighting module. For example, see FIGS. 8A-8B. If the curved mechanical plate is stiff and rigid, the curved module 35 will be stiff and non-flexible even if the lighting panel is flexible. In this embodiment, the male mechanical support connector section 3 is shown located on the short width dimension of the module. Alternatively, a flexible lighting panel could be used with a flexible mechanical plate and housing to create a flexible lighting module 37 as shown in FIGS. 8C-8D. In such embodiments, the male mechanical support connector section 3 would provide stiffness to the flexible mechanical plate only in the region of male mechanical support connector section 3. In this embodiment, the male mechanical support connector section 3 is shown located on the long length dimension of the module. Note that since the thickness of these curved modules would be less than the length or width, they should be considered flat lighting modules as defined herein.

Also included in the invention is a lighting module whose thickness is less than its width or length comprising at least one lighting panel, control circuitry for controlling the lighting panel(s), and electrical contact pads connected to the control circuitry, all supported at least in part by a mechanical support plate; the mechanical support plate being at least partially enclosed in a housing with a provision or opening so that light can be emitted from the lighting panel; and where the mechanical support plate includes at least one male mechanical support connector section wherein: the male mechanical support connector section extends out from the mechanical support plate in the same plane as the thickness of the lighting module; the male mechanical support connector section is not covered by the housing; the male mechanical support connector section includes means for non-permanent locking or latching when inserted into a corresponding receiver; and the male mechanical support connector section includes two wings located along the sides of a depressed channel. The corresponding receiver desirably has a female mechanical connector into which the male mechanical support connector section of the lighting module engages and which includes means for non-permanent locking or latching of the male mechanical support connector section of the lighting module as well as means for making electrical contact between the receiver and the contact pads within the lighting module. Such means include a male electrical extension that extends out from the female mechanical connector. The means for non-permanent locking or latching for both the lighting module and receiver are the same as described for the lighting module or lampholder parts of the electrical connection system. A lampholder, as described below, would be one type of a suitable receiver for the lighting module.

Desirably, the depressed channel of male mechanical support connector section of the lighting module above has one or more notches in its leading edge. Moreover, it is also desirable that the electrical contact pads of the lighting module are positioned over the depressed channel of the male mechanical support connector section so that the surface of the electrical contact pads aligns with the level of the wings.

In the electrical connection system, a lampholder will receive the male mechanical support connector. "Lampholder" is a general description and applies to any structure that, at a minimum, contains the female mechanical connector that receives and supports the male mechanical support connector section of the lighting module and a male electrical extension that supplies electrical power and communication signals to the lighting module. Thus, lampholder 20, as shown in e.g. FIG. 12A, comprises the minimum structure of a lampholder. Lampholder 20 can also be incorporated in a larger structure, as shown in e.g. FIG. 12B, and the entire structure can be referred to as lampholder 50.

The female connector of the lampholder has means that allow for non-permanent engaging, locking or latching of the lampholder to the male mechanical connector section of lighting module. The male mechanical connector section has corresponding means that engage the means of the lampholder to form the non-permanent lock. Such engaging, locking or latching means include, but are not limited to, features such as deformable prongs, pins, posts, springs, magnets, arms, holes, notches, bumps or depressions. These features can be of any appropriate size or depth and the edges of the features may be sharp or rounded. The engaging, locking or latching means are located in the female mechanical connector part of the lampholder and not on the male electrical extension. One desirable example of means for non-permanent locking in the female mechanical connector would be deformable springs which engage with corresponding holes in the male mechanical support connector section. Another desirable example would be posts above and/or below the male electrical extension which engage a notch in the leading edge of the male mechanical support connector section.

Along both sides of the female mechanical connector part of the lampholder, there are located two grooves, slots or channels which are configured to engage the wings of the male mechanical support section. These two grooves are located along the sides of the female mechanical connector so that the wings of the male mechanical support connector section of the metal plate of the lighting module can slide along the two grooves during connection of the lighting module to the lampholder. This provides a solid and robust mechanical connection between the lampholder and the lighting module. The top, bottom and side surfaces of the grooves may be formed as one solid piece as part of the lampholder. Alternatively, the top, bottom and side surfaces of the grooves may be formed from two or more separate pieces assembled together. The grooves may also be formed by a space between the top and bottom of the lampholder with no side wall.

As noted previously, the female connector part of the lampholder has corresponding means that cooperatively engage or interact together with the means of the male mechanical support plate connector to non-permanently hold the two connectors together. Such engaging, locking or latching features can also be part of the groove structures. For example, there may be features along the surfaces of the grooves that interact with the wings or corresponding features in the wings to non-permanently lock the male mechanical support connector section in position. For example, there may be small bumps along the wing edges that engage with into small depressions in the top or bottom of the groove channel. Another example could be deformable springs along the top, bottom or sides of the groove channels that apply pressure against the wings of the male mechanical support connector section when inserted. Another example would be magnets which engage with the wings of the male mechanical support connector section. In any case, pressure in the reverse direction releases these engaging features. These engaging features in the grooves may be used together with other means for non-permanent locking or latching.

The depth of the grooves into which the wings slide should be in the range of 0.3-7 mm, preferably 0.5-3 mm. The depth that the edge of the wing penetrates into the grove should be at least 0.1 mm and preferable, at least 0.3 mm.

However, these dimensions are not limiting and may be larger or smaller if necessary.

One important feature of the lampholder is the male electrical extension. As discussed above, this extends out from the female connector section of the lampholder to provide electrical contact with the control circuitry within the lighting module. This male electrical extension generally has no active circuitry. This reduces the overall cost of the lampholder. Generally, the male electrical extension will be connected to a power source on its lampholder end. The power source for the lampholder is not critical and the lampholder may be connected to any electrical power source suitable for supplying electricity to the lighting module as known in the art including, but not limited to, battery power, AC or DC power, or high or low voltage. The connection of the lampholder to the power source is also not critical and may take any form known in the art including, but not limited to, direct wire connection, a screw-type socket or a plug type socket with 2 or 3 prongs. The lampholder can optionally have additional control circuitry such as transformers, a PCB or sensors that modulate the voltage or current supplied to the male electrical extension. The male electrical extension has conductive pathways that are either embedded in the extension or located on the surface that end in contact structures. The contact pads of the male electrical extension are located and selected appropriately to make contact with the electrical contact pads that are either on or connected to the control circuitry in the lighting module. In some embodiments, the contact pads of the male electrical extension are flat contact pads since this will reduce the costs of manufacture. Other embodiments may use spring-type contact pads. Contact pads can be formed on both top and bottom sides of the male electrical extension, which enables reversibility of the electrical connection system.

The male electrical extension needs to fit within the depressed channel of the male mechanical support connector section in terms of height, width and length. Typically, the thickness of the male electrical extension should be slightly less (at least 0.001 mm, preferably at least 0.05 mm) than the depth of the depressed channel, typically in the range of 0.095 to 4.95 mm, preferably 0.395 to 2.95 mm. The width of the male electrical extension should be at least 0.05 mm less than the width of the depressed channel. In absolute terms, the desirable width should be 24.95 mm or more. The length of the male electrical extension should be the same or less than the length of the depressed channel. In absolute terms, the length should be at least 10 mm or more. However, these dimensions are not limiting and may be larger or smaller if necessary.

The male electrical extension can be made of any suitable non-conductive material. While it should be stiff enough to slide along inside the depressed channel of the male mechanical support connector section without deforming to the degree that the appropriate electrical connections are not made, it is not necessarily needed to supply additional mechanical support of the connection system. It should be flat; that is, its thickness should be less than either its length or width. While the thickness of the male electrical extension is not critical, it needs to be the appropriate thickness to slide beneath or above the control circuitry and its contact structures.

The lampholder can be covered with a housing. The housing can be made in one piece or more typically, be made of multiple pieces, which may be replaceable such as a removable front and back cover. The housing can be made of metal or plastic. The lampholder can also be mounted on a suitable support base such as metal or plastic. This support base, along with the lampholder, can be covered by the housing or be part of the housing. For some embodiments, it is desirable that the lampholder housing in the vicinity of the connection has the same thickness and width as the housing of the lighting module in the vicinity of the connection. This provides an esthetically pleasing sleek and continuous appearance of the combination when connected.

In the disconnected state, the male electrical extension of the female connection of the lampholder could extend past the housing. This could result in exposed electrical areas that could be live in the disconnected state. This may not be a problem since the voltage is low (a Class 2 electrical contact). If desired, a microswitch may be incorporated to turn off the power to the male electrical extension whenever there is disconnection. Alternatively, the housing of the lampholder could be extended past the end of the male electrical extension thus protecting its electrical contacts from physical contact. In this case, the thicknesses at the ends of the lighting module housing and the lampholder housing can be mutually adjusted so that one slides over the other. This would create a seamless effect with no visible gaps when connected.

Figure 9:
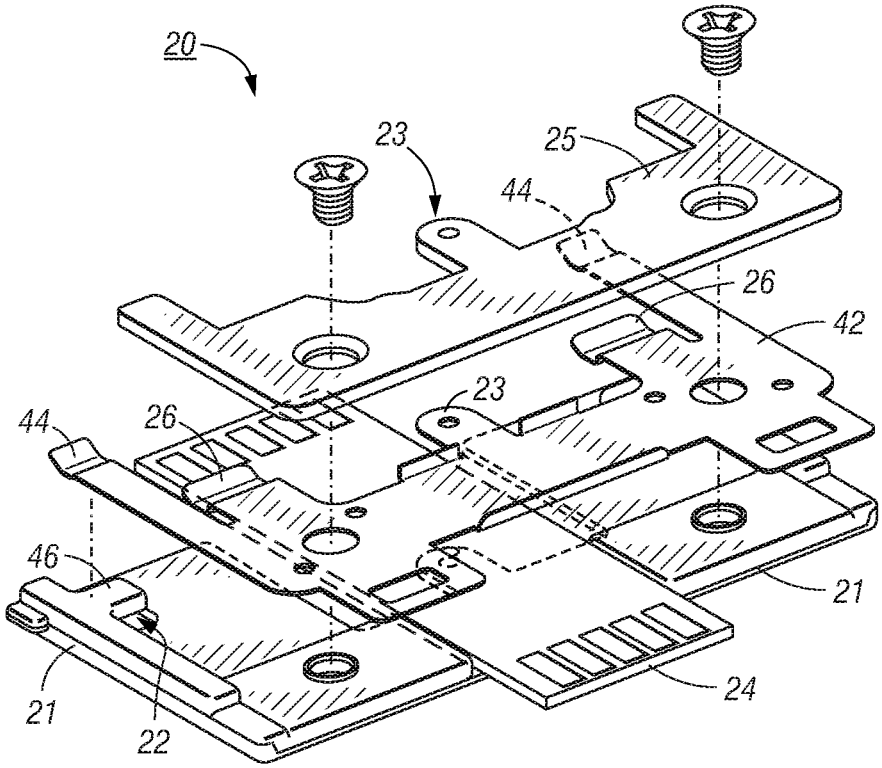
FIG. 9 shows an exploded schematic for one design of a female lampholder connector suitable to make connection with the male mechanical support connector section of the lighting module in two orientations.

FIG. 9 shows an exploded view of one embodiment of a lampholder. In this embodiment, the lampholder 20 comprises a bottom plate 21, an intermediate spring plate 42 and a top plate 25 which are fastened together. The spring plate 42 is located over the male electrical extension 24 and under the top plate 25 and has springs 26 (that will engage with the holes 6 in the male mechanical support connector section 3 when connected). When assembled, the long finger spring 44 will fit under protruding retaining arm 46 and becomes the top surface of the side groove 22 of the female mechanical connector of the lampholder. The bottom surface of the side groove 22 is the upper surface of the bottom plate 21 and the side wall of the groove 22 is formed by the thick side wall (not labelled) of the bottom plate 21. In this way, the long spring arm 44 can supply pressure to the wing 5 of the male mechanical support connector section 3 to hold it securely when connected but has enough flex to allow easy insertion. The amount of flex is limited by the protruding retaining arm 46 which limits the travel of the finger spring 44. There are posts 23 on the top plate 25 and the spring plate 42 (as shown) as well as a corresponding post 23 (not visible) on the bottom plate 21. Post 23, located on both sides of the male electrical extension 24, can engage notch 18 in the leading edge 40 of the male mechanical support connector 3 when connected. In this way, the male mechanical support connector section 3 of the lighting module 11 can be inserted in two different, but opposite, orientations (one where the depressed channel 4 lies above the male electrical extension 24 and the other where the depressed channel 4 lies below the male electrical extension 24). In either orientation, the wings 5 are held securely in the side grooves 22 by spring arm 44 in a detachable, non-permanent way and the notch 18 fits against the post 23. In addition, springs 26 in holes 6 form a detachable, non-permanent connection between the lighting module 11 and the lampholder 20 which, when sufficient opposite pressure is applied, allows the two to be detached from each other into separate components.

In some embodiments, it is desirable to limit the insertion of the lighting module to a single orientation. This is best accomplished by designing the lampholder side of the connection to prevent the improper insertion of the lighting module, as opposed to changing the design of the module. In this way, the same module can be used for both reversible and non-reversible lampholders. This may be accomplished in numerous ways including, but not limited to, designing the housing so that the male mechanical support connector section cannot fit into one side of the lampholder or putting blocking structures within one side of the female lampholder connector so that the male mechanical support connector section cannot be inserted.

Figure 10:
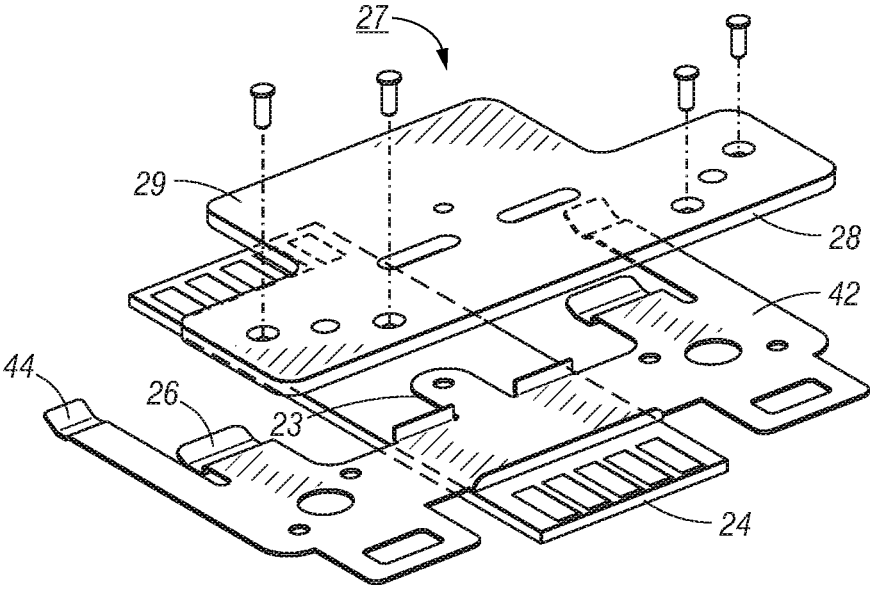
FIG. 10 shows an exploded schematic of a lampholder subassembly suitable to make connection with the male mechanical support connector section of the lighting module in a single orientation.

FIG. 10 shows an exploded view of a non-reversible lampholder subassembly. In FIG. 10, the single orientation lampholder subassembly 27 has a top plate 28 which has a solid extension 29 to block the leading edge 40 of the male mechanical connector 3 from being inserted on the top side of the male electrical extension 24. However, the depressed channel 4 of the male mechanical support connection 3 can still slide under the male electrical extension 24 of the lampholder subassembly 27. This restricts to the insertion of the lighting module 11 into the lampholder 27 to a single orientation. The single orientation lampholder subassembly 27 can use the same male electrical extension 24, spring plate 42 and bottom plate 21 as shown in FIG. 9 to form a similar three plate structure as in reversible lampholder 20 and will function and operate in the same way except for allowing insertion in only one orientation.

For both the reversible lampholder 20 and the single orientation lampholder 27 embodiments, the bottom plate 21 may be replaced by similar structures (e.g. the retaining arm 46, post 23, holes for screws or rivets, etc.) located directly on a supporting structure. Elimination of a separate bottom plate and replacement by the same structures on a supporting structure will allow for a thinner connection compared to directly locating a lampholder with the bottom plate 21 on a supporting structure. For example, the lampholder subassembly 27 can be directly attached to a metal base unit which has been milled to form all of the same structures found in the bottom plate 21 as in FIG. 9. Alternatively, the base unit can be plastic where the same structures found in bottom plate 21 have been molded into the surface.

One embodiment of a suitable male electrical extension is shown in FIGS. 11A-11B. A male electrical extension 24 has electrical contact pads 30 on both sides of the end that will fit into the lighting module. Electrical contact pads 30 are connected through electrical connectors 31 to contact areas 32 on the lampholder end that will be connected to a power source. There is shown an optional hole 33 which allows a post (e.g. post structure 23) to extend from the bottom plate (i.e. 21 in FIG. 9) through the male electrical extension (and the spring plate 42) to the top plate (i.e. 25 in FIG. 9). This stiffens the lampholder and positions/stabilizes the male electrical extension within the lampholder. Alternatively, the hole may be replaced with a circular (although other shapes are possible) depression on only one side of the male electrical extension in order to act as a detent to part of the spring plate 42 to help position/stiffen the spring plate 42 and the male electrical extension.

Figure 12A:
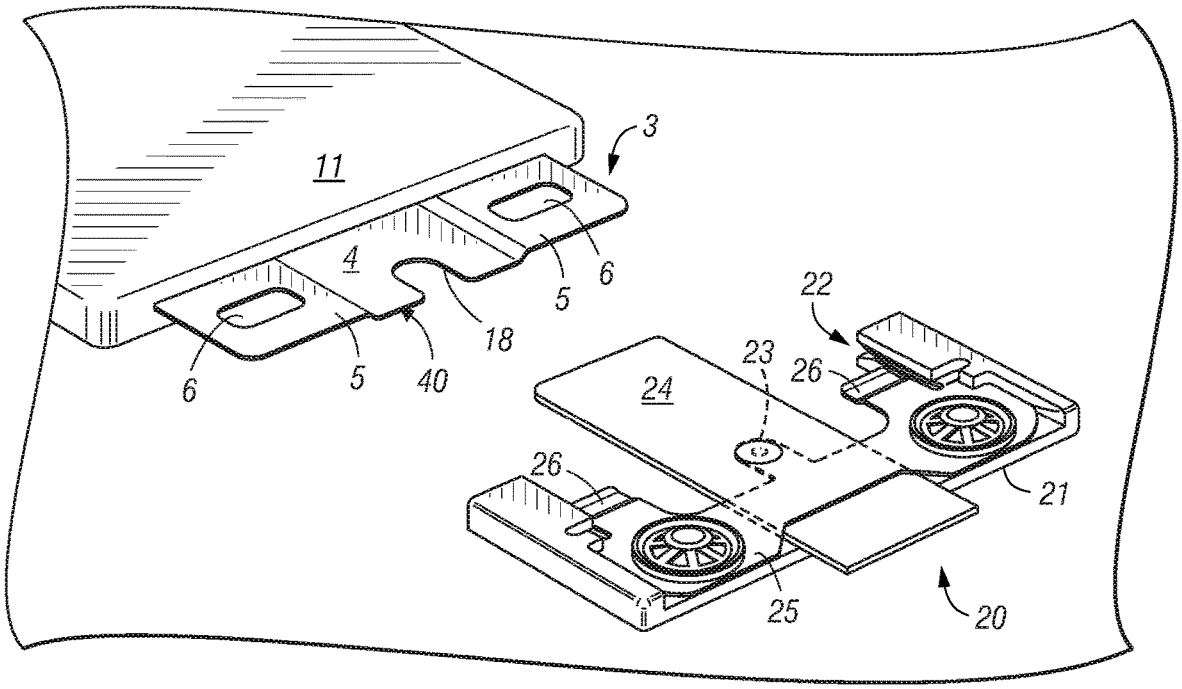
FIG. 12A shows the orientation before connection between the male mechanical support connector of the lighting module and the lampholder. Other lampholder details along with the electrical connections of the male electrical extension have been omitted for clarity.
Figure 12B:
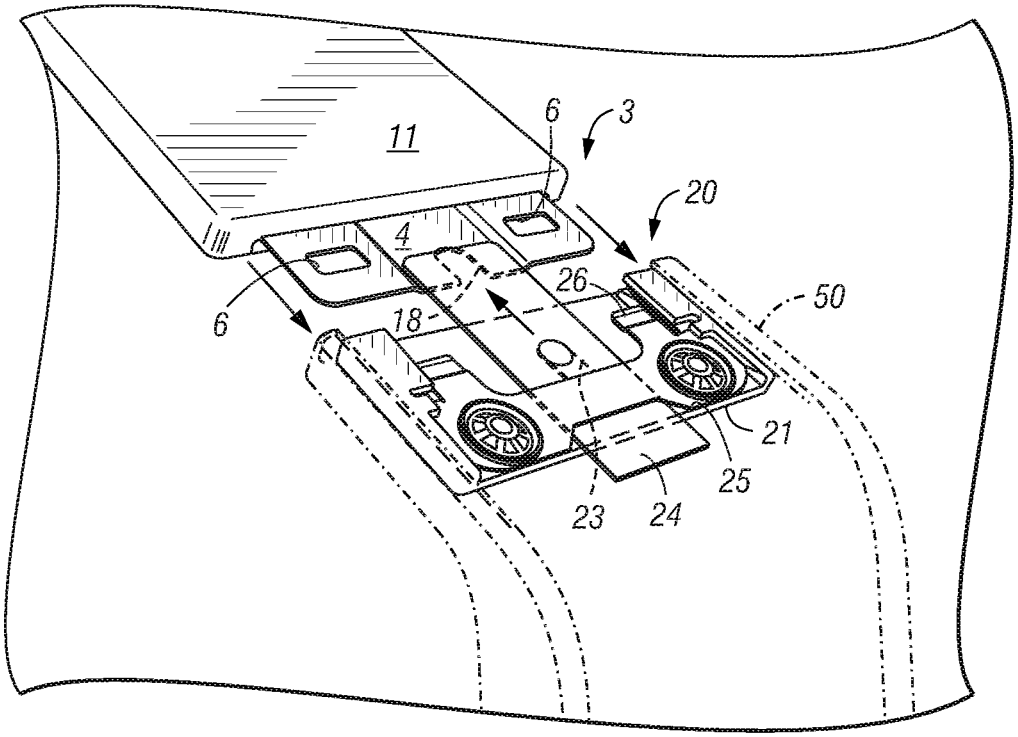
FIGS. 12B and 12C show the insertion of the flat lighting module into a lampholder.
Figure 12C:
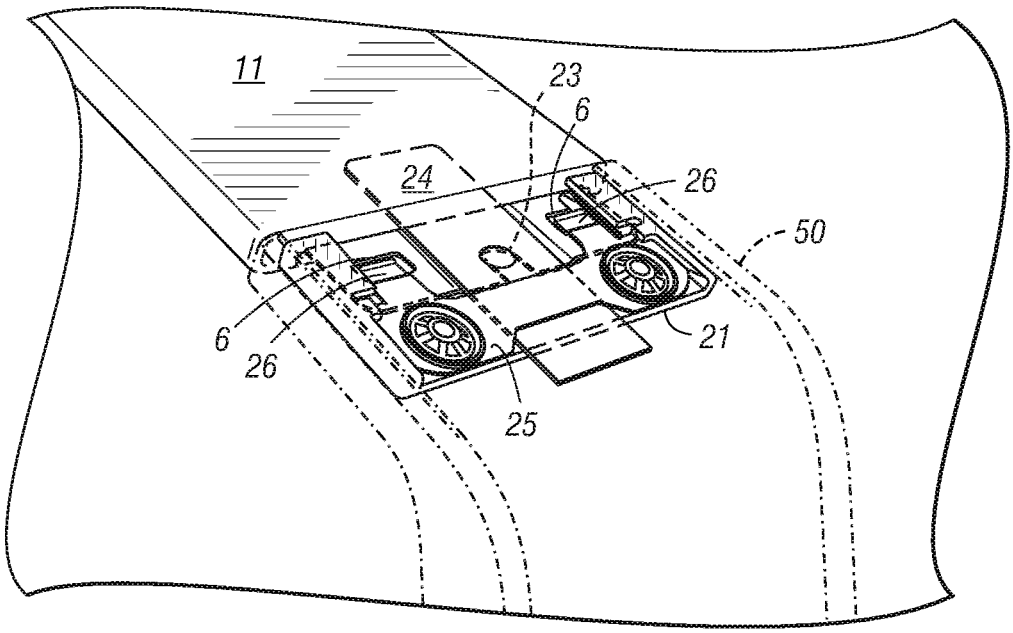

FIG. 12A demonstrates the orientation of the lighting module and lampholder before connection. One edge of the complete lighting module 11 has an exposed male mechanical support connector section 3 with wings 5 on either side of a depressed channel 4 with holes 6 in the wings along with a notch 18 on the leading edge. In this embodiment, the lampholder 20 has a male electrical extension 24 between a bottom plate 21 with a protruding post structure 23 to engage the notch 18 of the mechanical support connector and side grooves 22, which are molded directly as part of the bottom plate 21, to receive the wings 5 of the mechanical support connector. Also shown is a top plate 25 with springs 26 for engaging the holes 6 in the wings of the lighting module 11. In this lampholder embodiment, there is no separate spring layer 42 as shown in FIGS. 9 and 10. FIG. 12B illustrates that the depressed channel 4 of the male mechanical support connector section 3 of the lighting module 11 will slide below the male electrical extension 24 as the wings 5 slide into and along the grooves 22 as the connection is made. As shown in FIG. 12B, when connected, the notch 18 will engage the post structure 23 of the bottom plate of the lampholder while springs 26 in the lampholder will drop into holes 6 in the wings 5 as the connection is made in order to secure the connection. Sufficient pressure in the reverse direction will disengage the springs 26 from the holes 6 and allow for the detachment of the lighting module 11 from the lampholder 20. As not shown in the Figs. for clarity, the electrical contact pads 30 on the male electrical extension will make electrical contact with the electrical contact pads (e.g. 19 in FIGS. 3 and 9 in FIG. 6A) within the light module 11 when fully connected as shown in FIG. 12C.

Figure 13A:
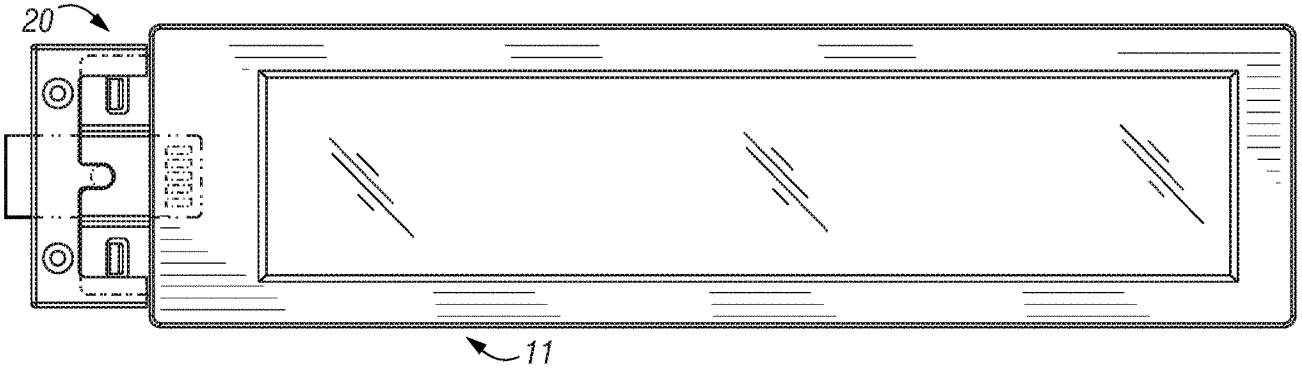
FIGS. 13A-13C show top, side and bottom views of the electrical connection system where a flat lighting module and a lampholder are connected.
Figure 13B:
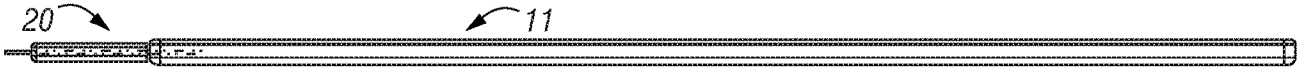
Figure 13C:
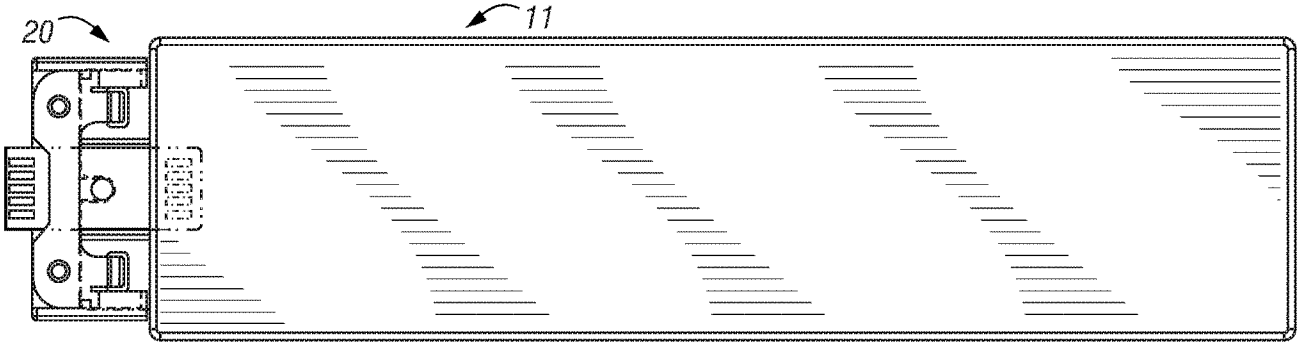
Figure 14:
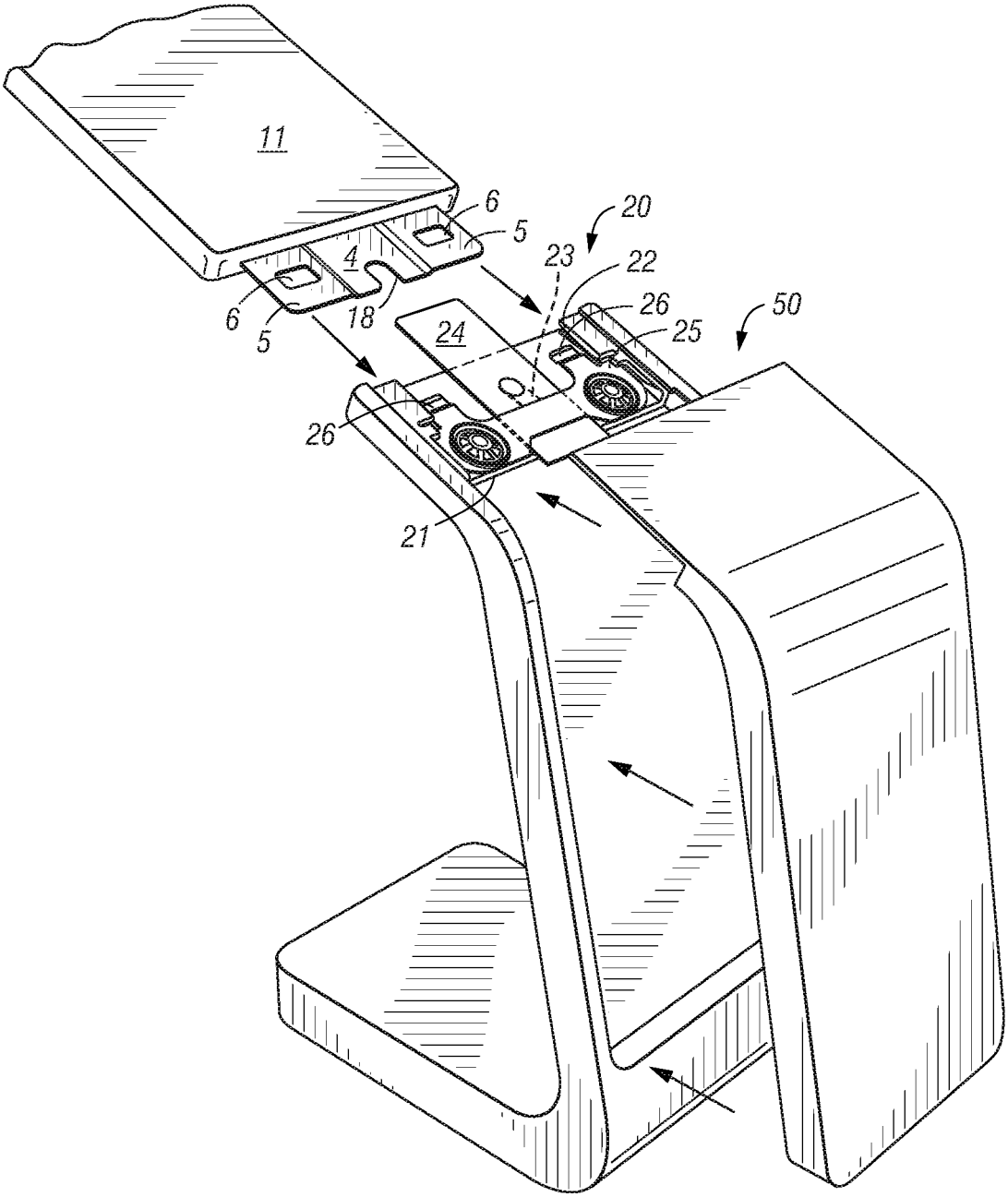
FIG. 14 shows an example of an exploded view of how, in one embodiment, the female lampholder connector is positioned within the body (base unit) of a luminaire and how it is orientated towards the lighting module before connection. Internal wiring details are not shown for clarity.
Figure 15A:
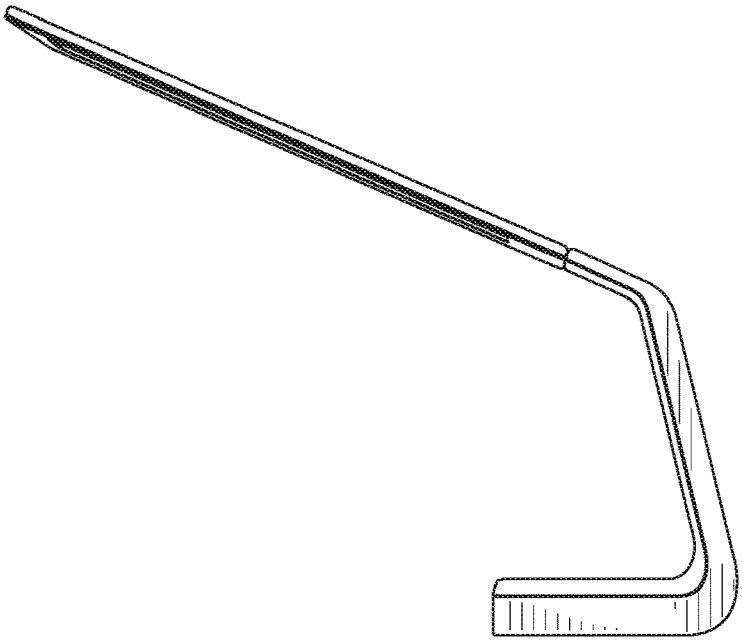
Figure 15B:
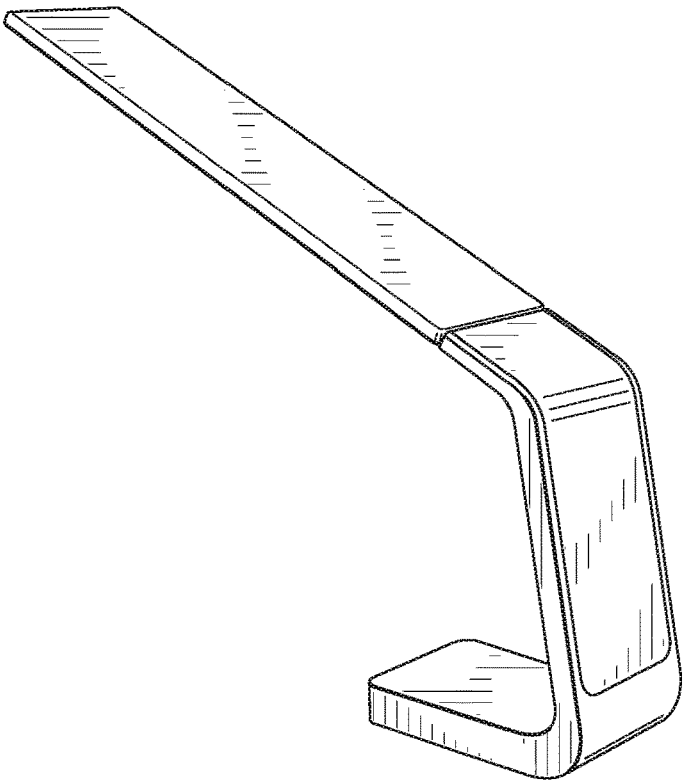
Figure 16A:
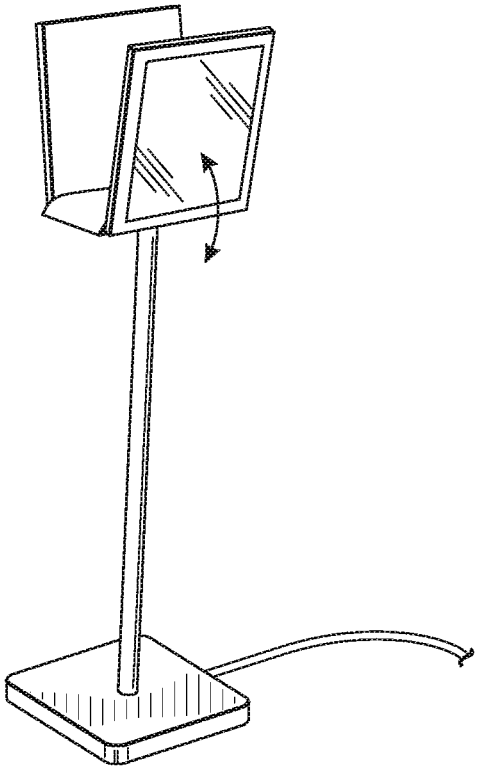
Figure 16B:
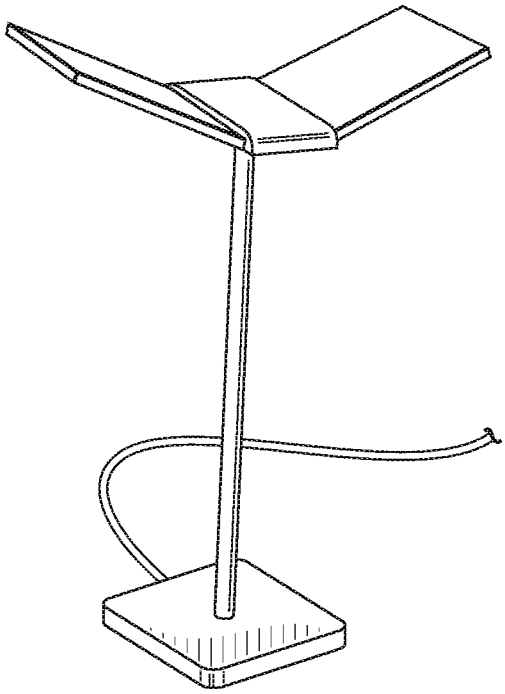
Figure 17A:
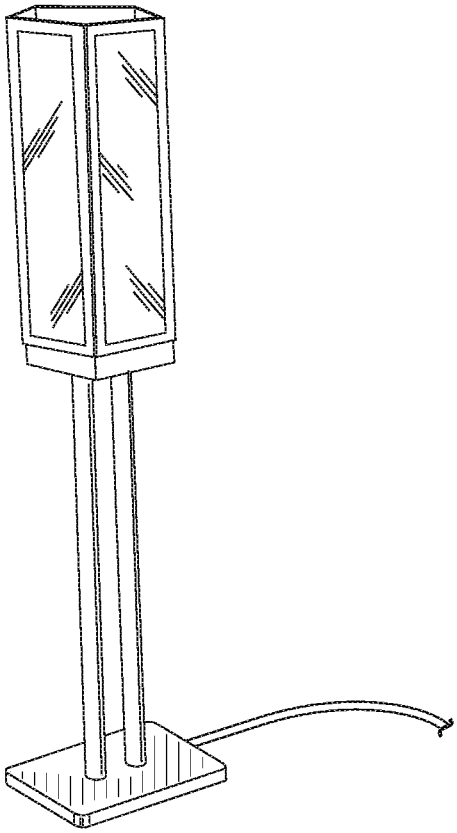
Figure 17B:
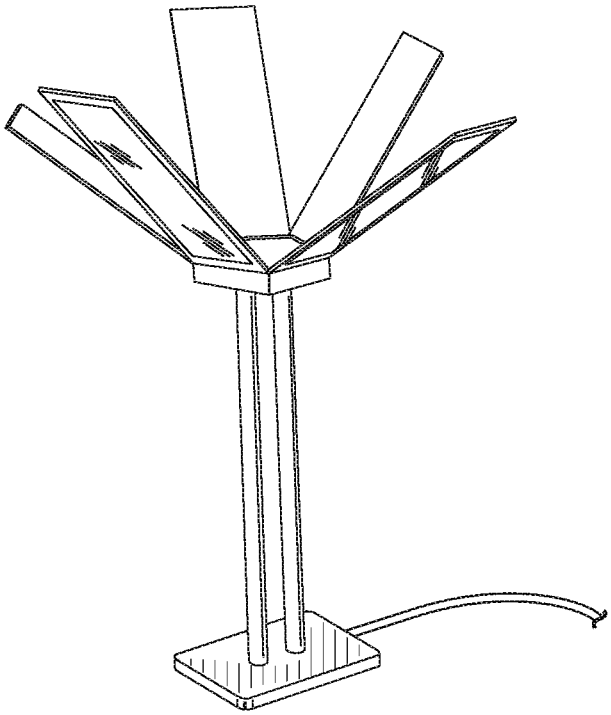
Figure 19A:
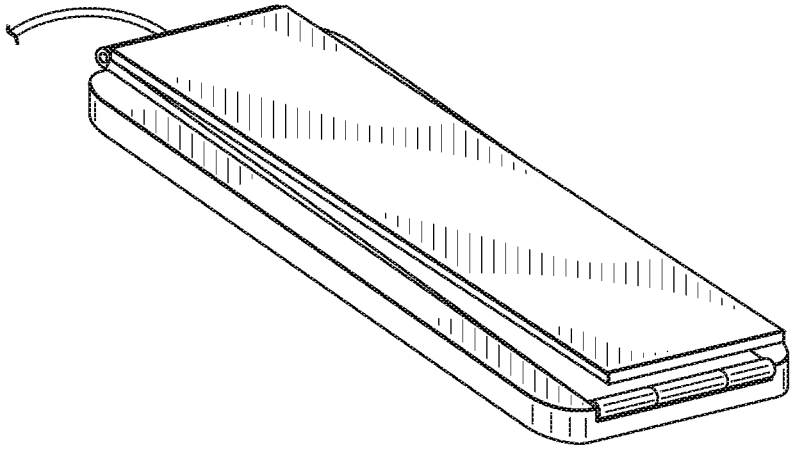
Figure 19B:
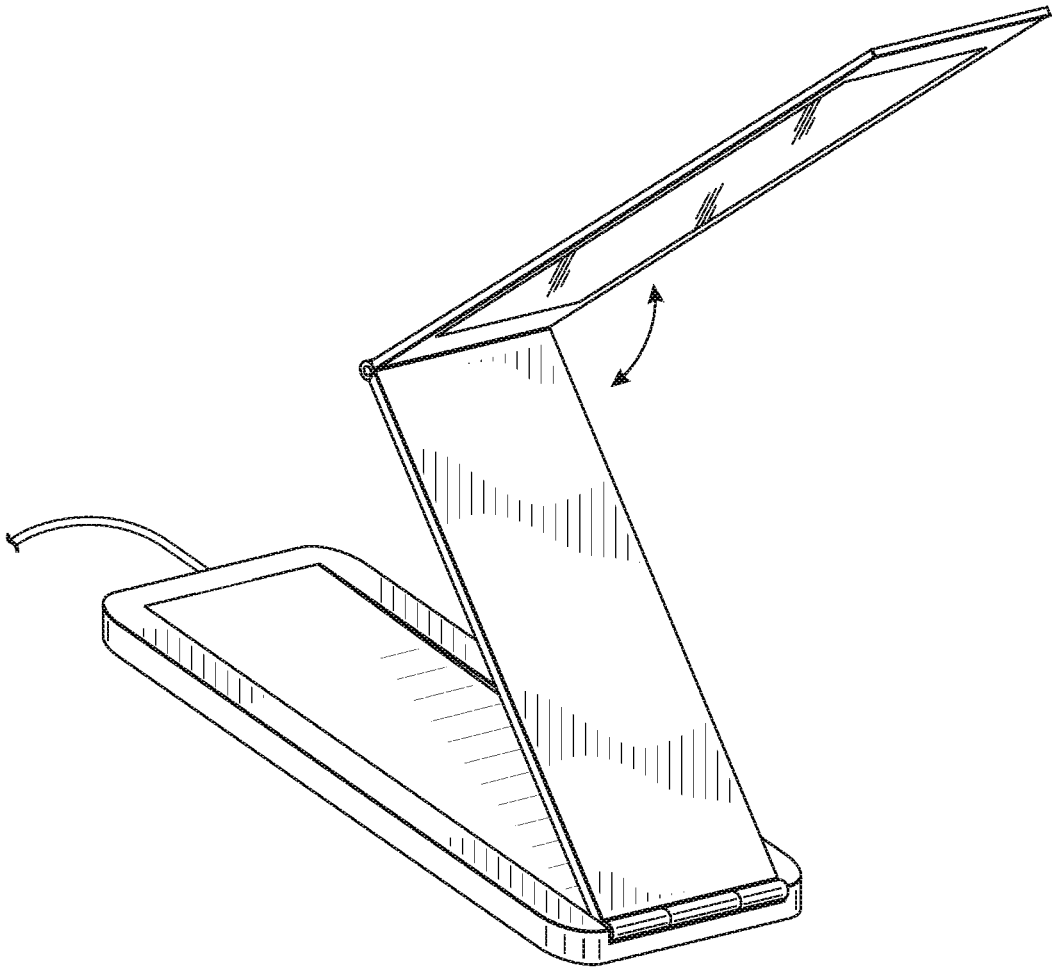
Figure 20A:
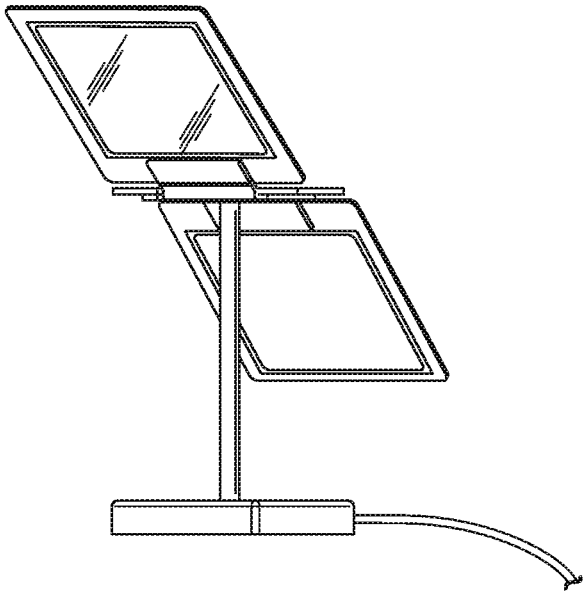
Figure 20B:
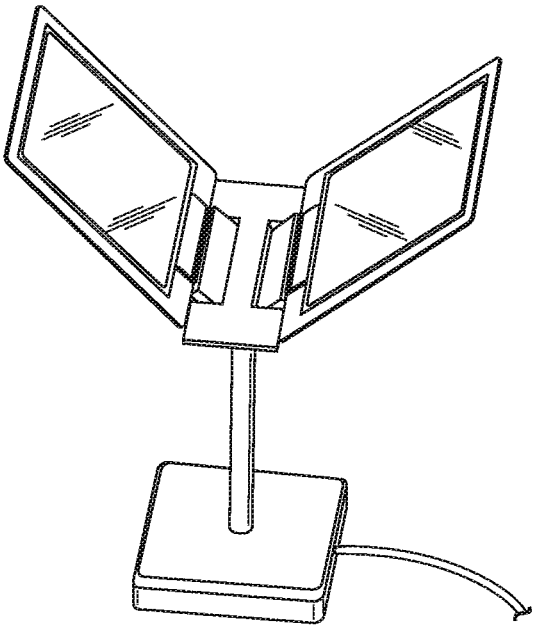

FIGS. 13A-13C shows top, side and bottom views of the complete electrical connection system where a flat lighting module 11 and a lampholder 20 are connected. Note that the electrical contact pads of the male electrical extension are located within the lighting module. For clarity, the support and electrical connections of the lampholder are not shown. FIG. 14 illustrates the mounting of the lampholder 20 in a base unit of a luminaire and how the lighting module 11 is orientated before insertion into the lampholder. A luminaire back plate can cover the lampholder so that the male mechanical support connector section and the lampholder of the electrical connection system are not visible.

The lighting module can also incorporate a lampholder as described above. The lampholder would have the opening of the female mechanical connector and male electrical extension in the same plane as the male mechanical support connector section and the lampholder would be along a different thinnest edge, preferably the opposite thinnest edge, from the male mechanical support connector section. In particular, a first flat lighting module would additionally include at least one lampholder; the lampholder comprising a female mechanical connector into which the male mechanical support connector section of a second flat lighting module engages and which includes means for non-permanent locking or latching of the male mechanical support connector section of the second flat lighting module; and a male electrical extension which engages the electrical contact pads in the second lighting module to supply electrical power or communication signals or both to the control circuitry of the second flat lighting module when the second flat lighting module and the lampholder of the first lighting module are connected. In this way, a connected series of lighting modules could be supported and powered from one base lampholder. For example, see FIG. 24.

Also, included in the invention is a lampholder comprising a female mechanical connector with two grooves, means for non-permanent locking or latching to a corresponding male connector, and a male electrical extension that extends out from the female mechanical connector. The female mechanical connector can additionally include springs, posts, pins or vertical structures located beneath and/or above the male electric extension of the lampholder. The corresponding male connector desirably has wings that engage the two grooves in the female mechanical connector and includes means for non-permanent locking or latching to the female mechanical connector of the lampholder, as well as the ability to receive the male electrical extension of the lampholder. The means for non-permanent locking or latching for both the lampholder and the male connector are the same as described for the lighting module or lampholder parts of the electrical connection system. The male mechanical support connector section of a lighting module as described above would be one type of a suitable male connector for the lampholder.

Figure 21B:
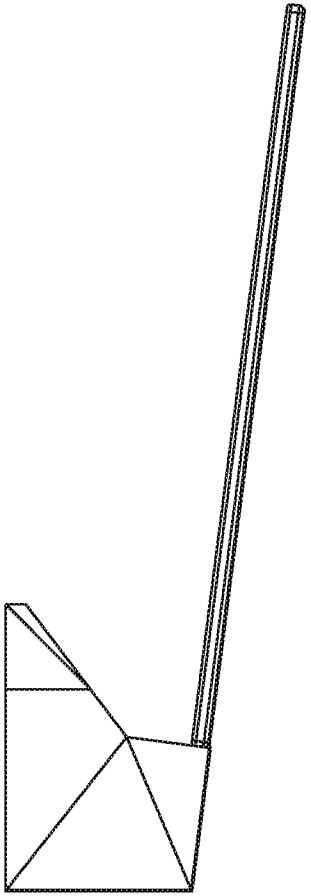
Figure 21A:
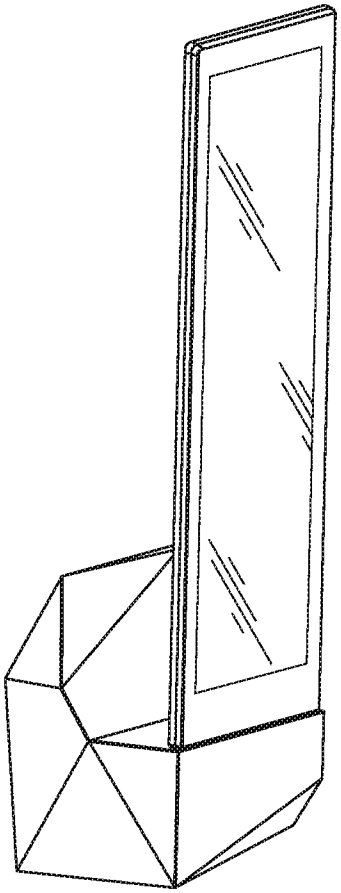
Figure 22:
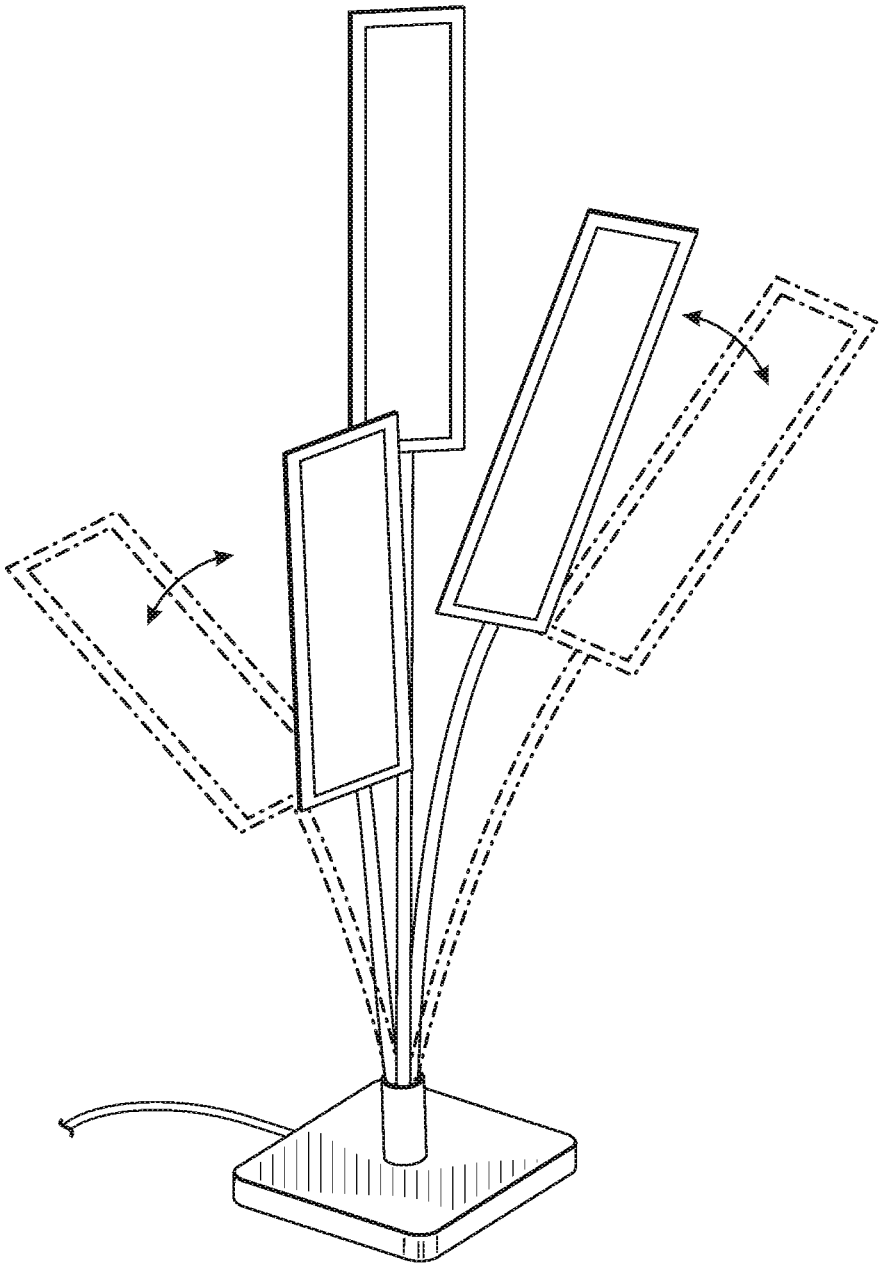
Figure 23A:
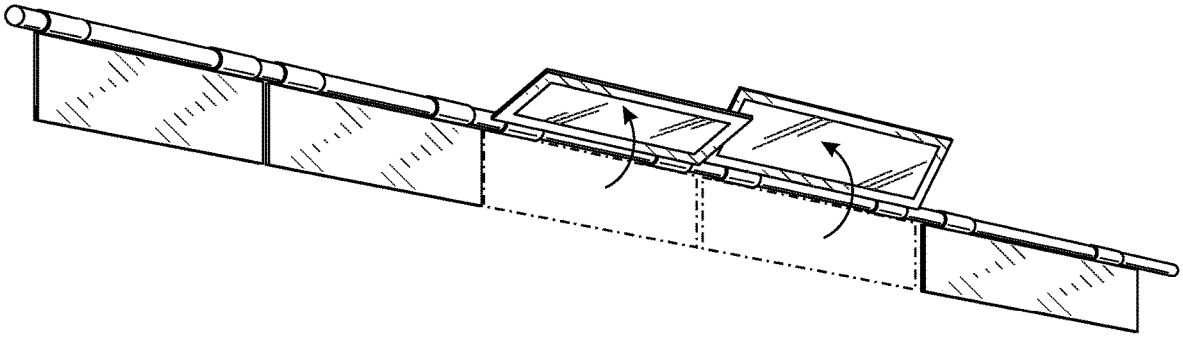
Figure 23B:
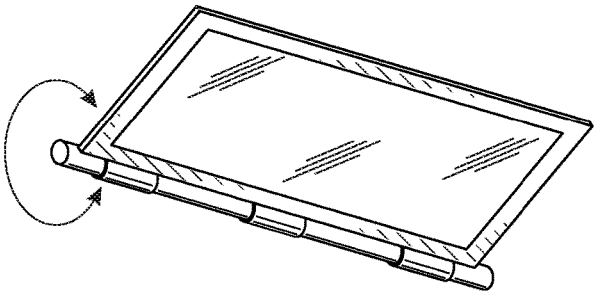
Figure 24:
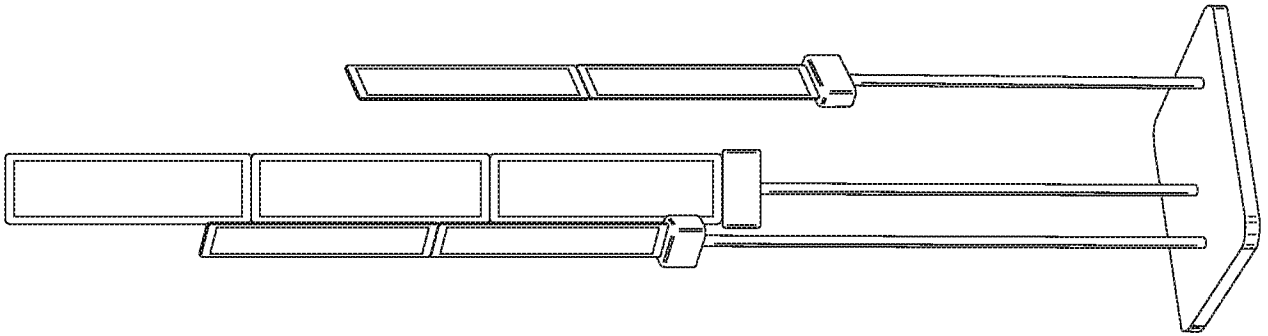
Figure 25A:
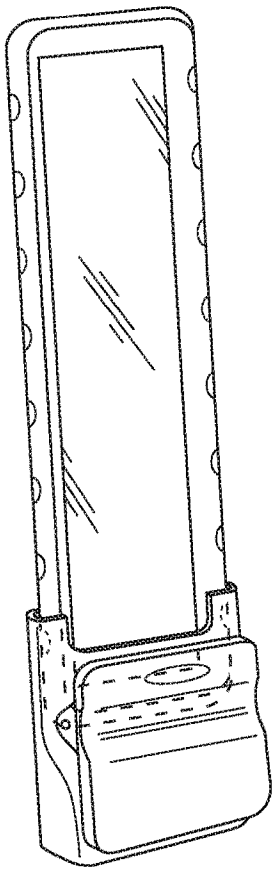
Figure 25B:
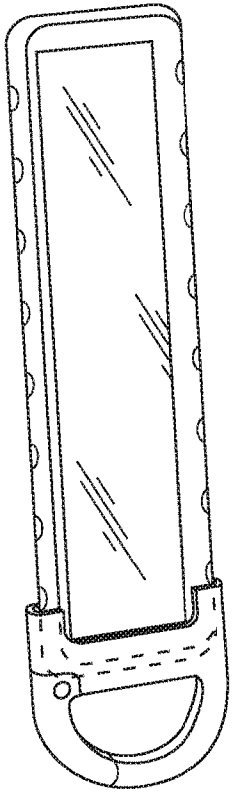
Figure 25C:
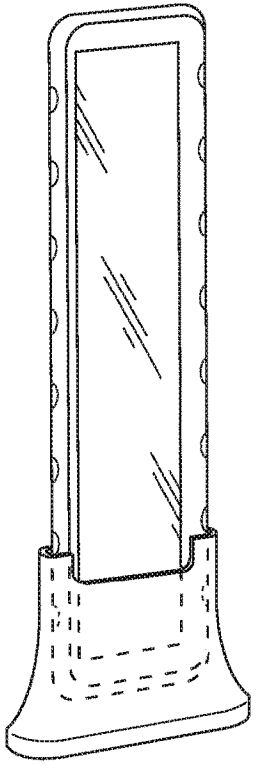
Figure 25D:
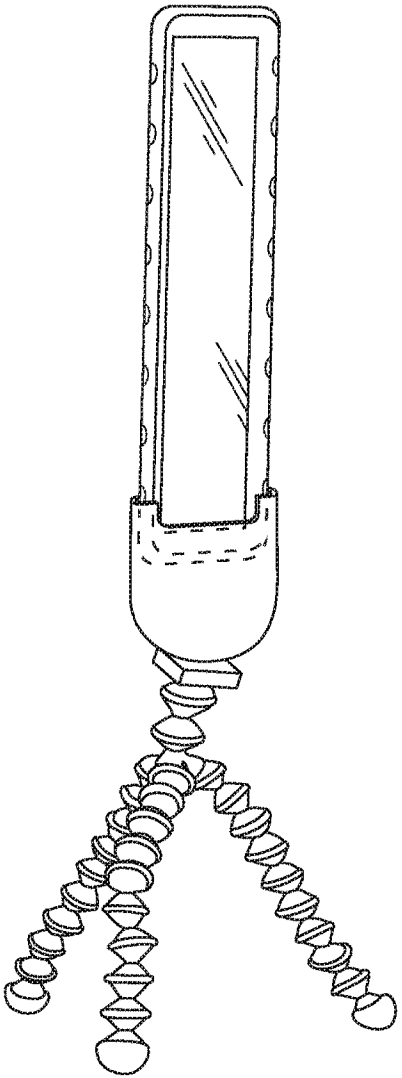
Figure 25E:
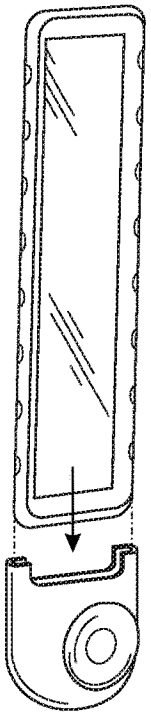
Figure 26:
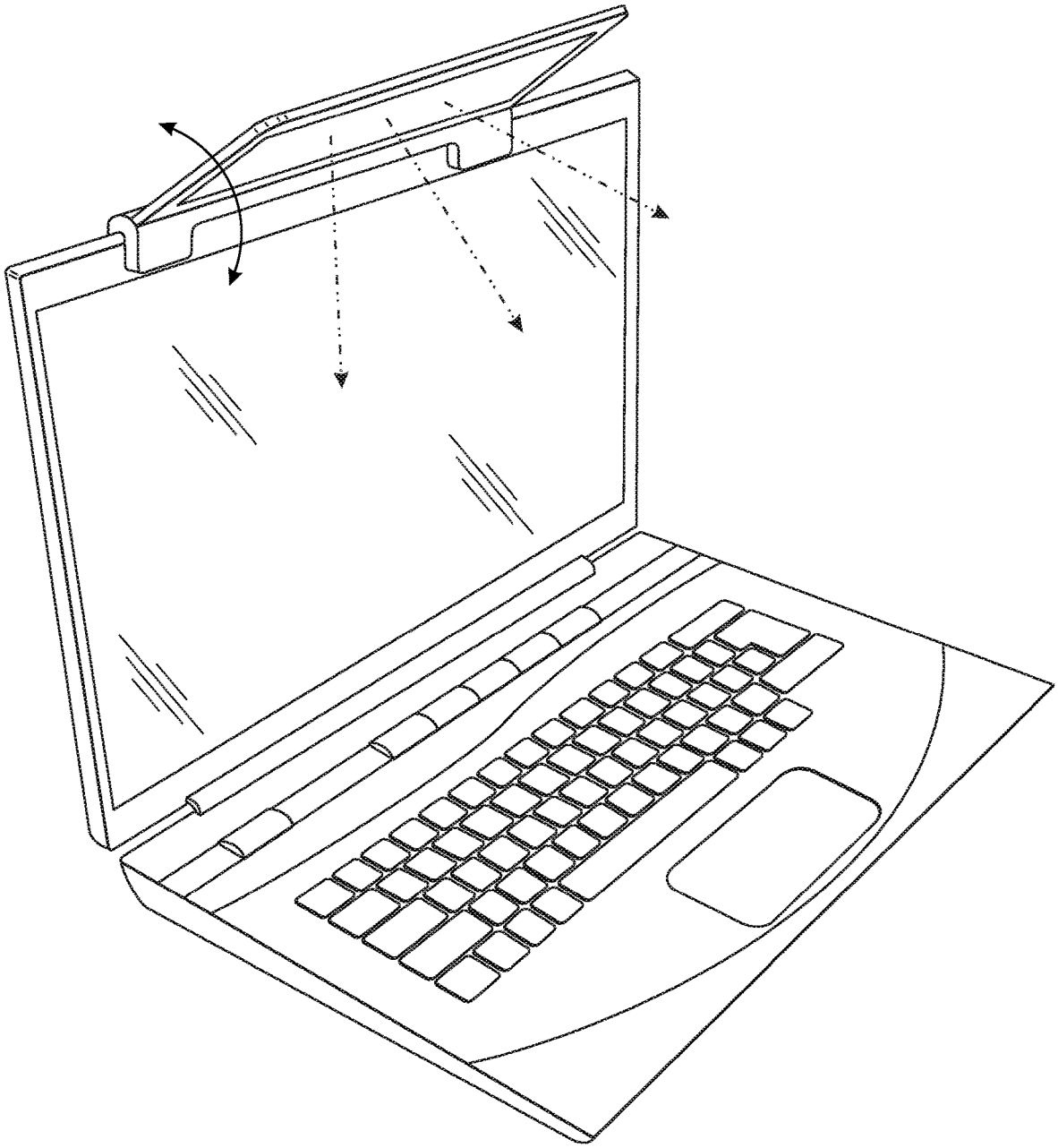
Figure 27A:
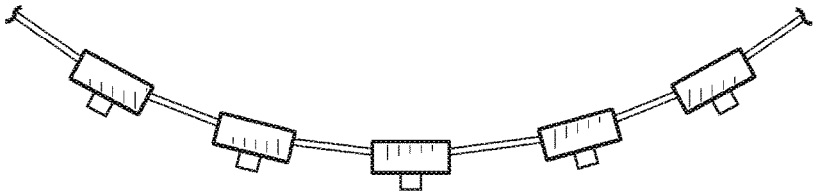
Figure 27B:
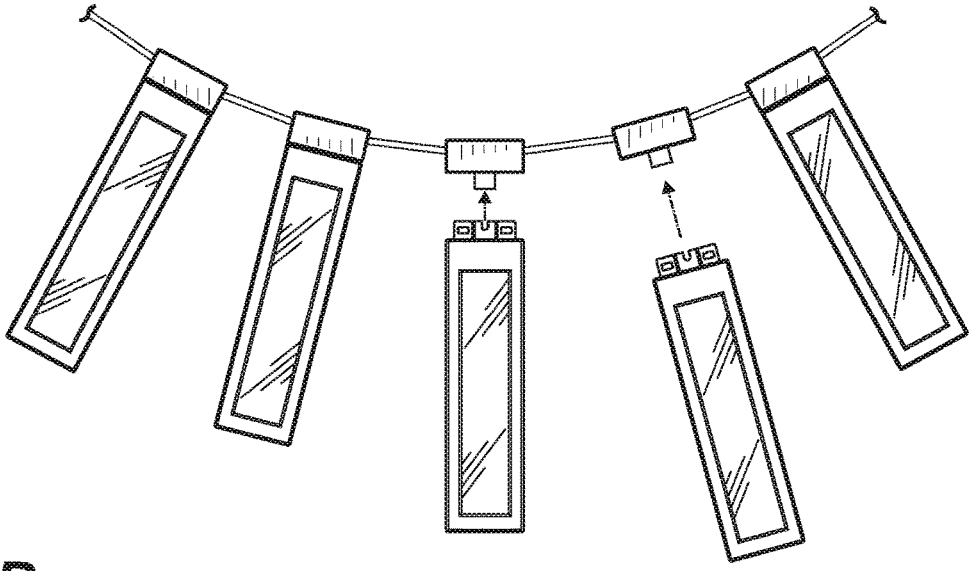
Figure 27C:
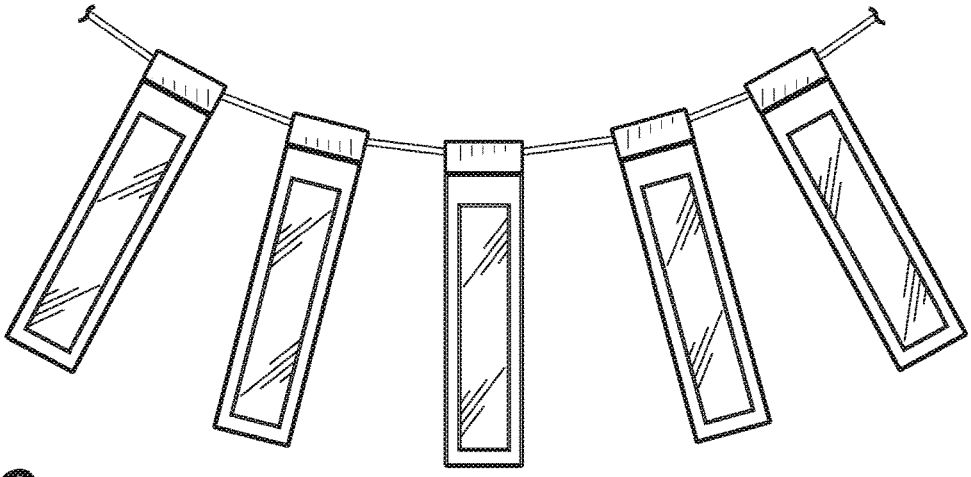

The complete flat detachable electrical connection system (the lampholder with the lighting module) can be part of a functional lighting device (also referred to as luminaire, lamp or lighting fixture); for example, a desk, table or floor lamp, a wall sconce, or a chandelier. The lighting module, which contains the lighting panel, is the light source for the luminaire. Some examples of luminaires that utilize the flat detachable electrical connection of the invention can be seen in FIGS. 15-31. FIGS. 15-17, 19-20, 22 illustrate some typical desk lamp designs. FIGS. 18 and 21 show some typical wall sconce designs. FIGS. 23-24 illustrates some hanging chandelier or ceiling lighting designs. In these examples, the lampholder side of the electrical connection system supports the lighting module, which has no support other than the lampholder.

In some embodiments, the lampholder side of the electrical connection system does not supply any fixed support to the lighting module when connected and the lighting module is supported by another means. This means can be some part of the luminaire different from the lampholder or some other type of support structure unrelated to the lampholder such as an independent clip.

Figure 28A:
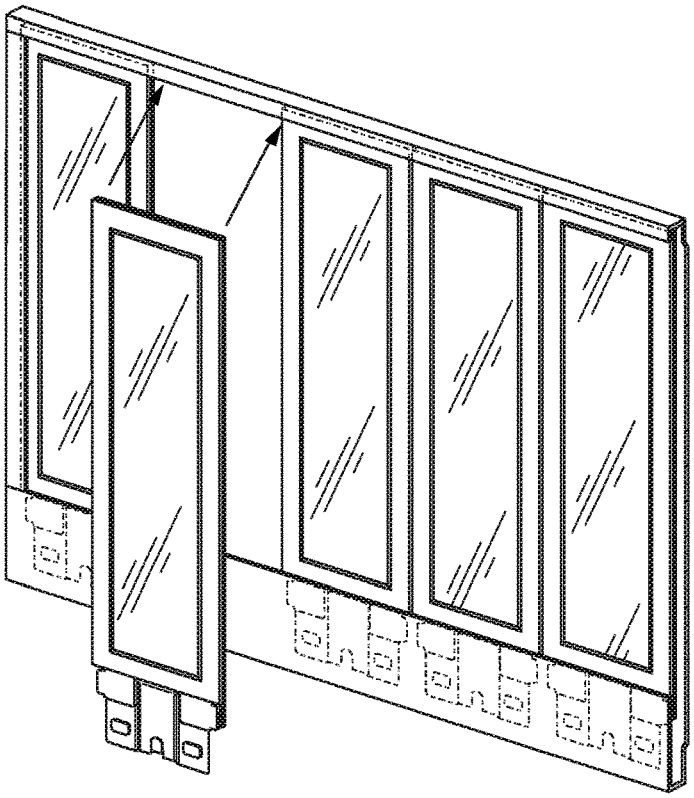
Figure 28B:
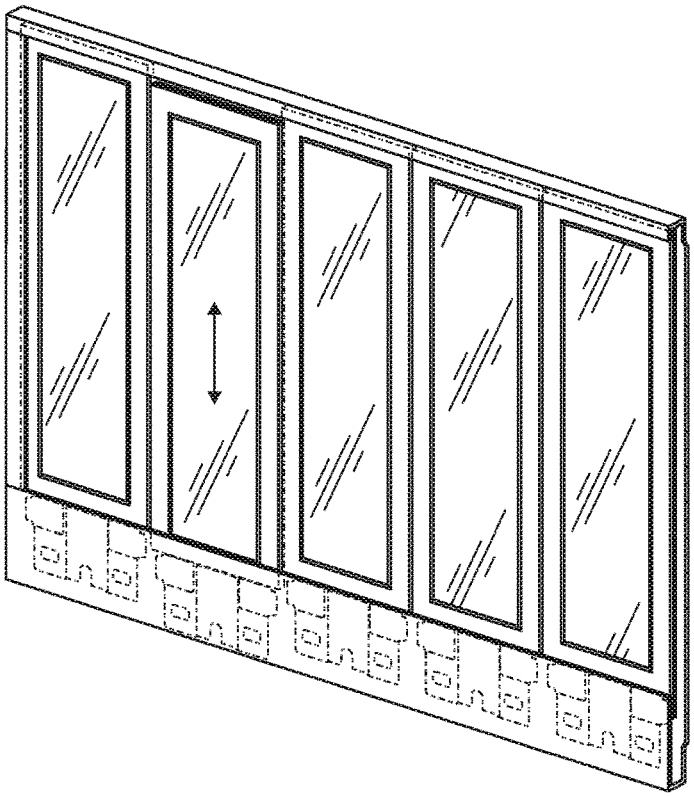
Figure 28C:
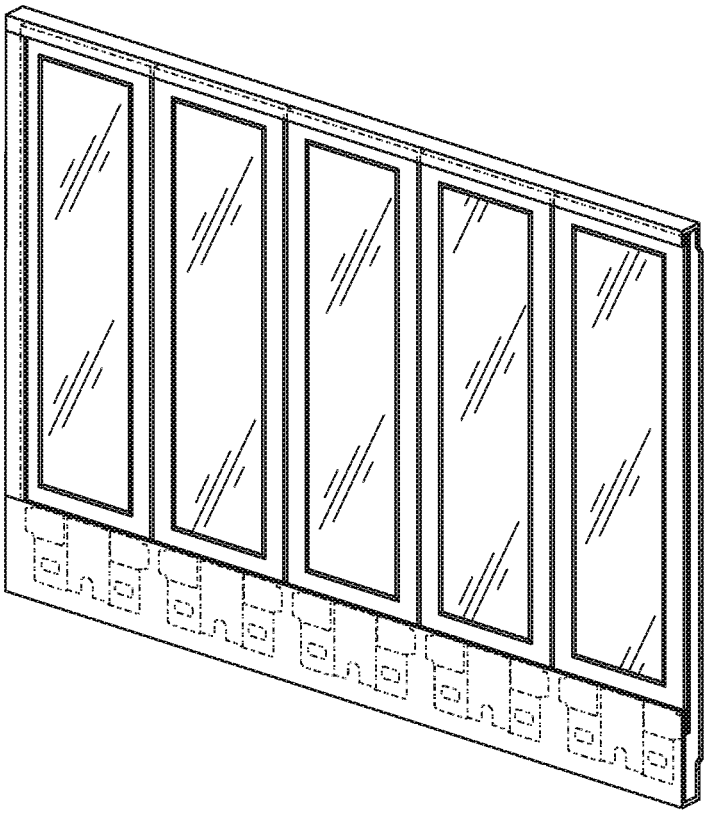
Figure 29A:
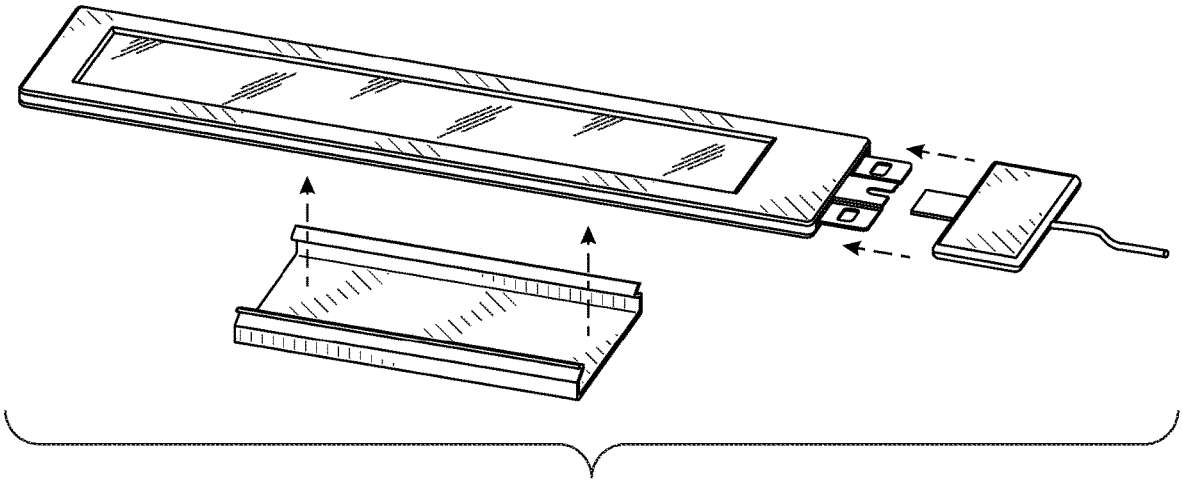
Figure 29B:
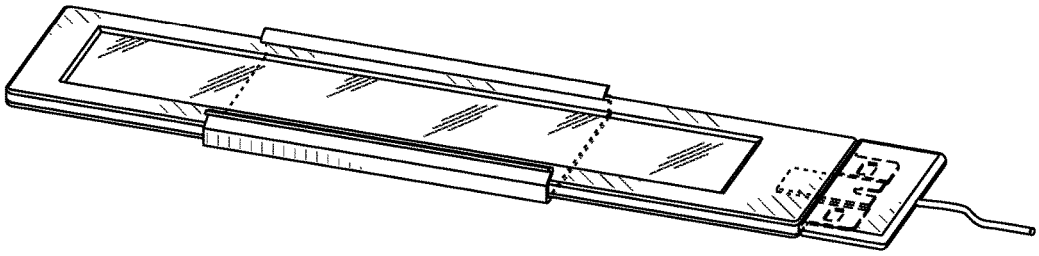
Figure 30A:
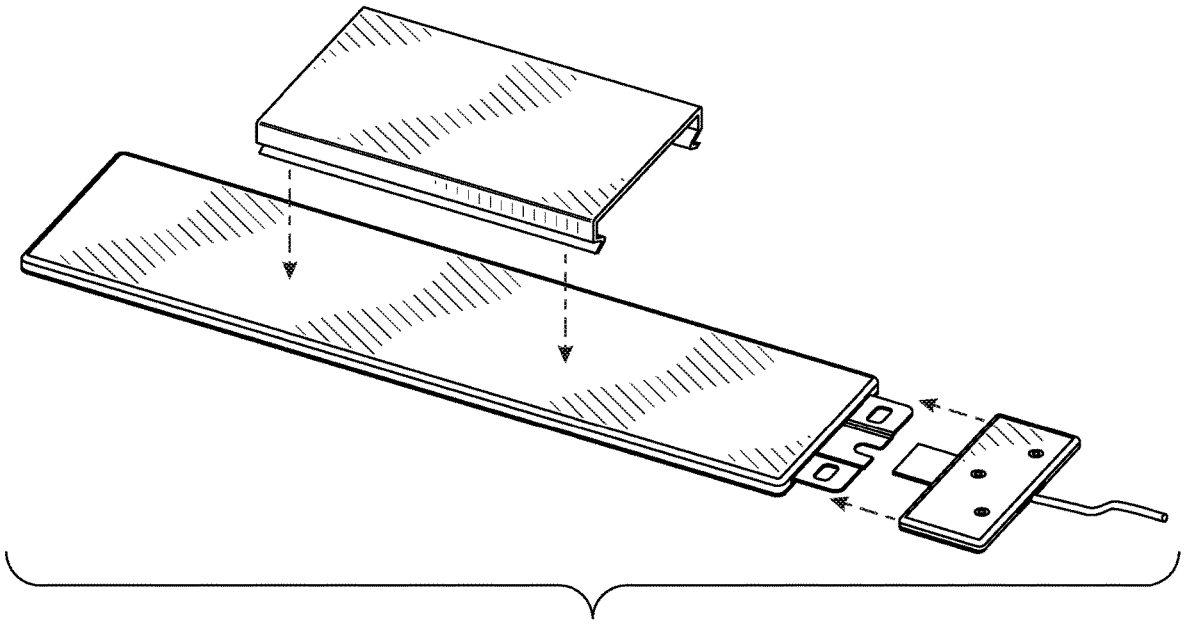
Figure 30B:
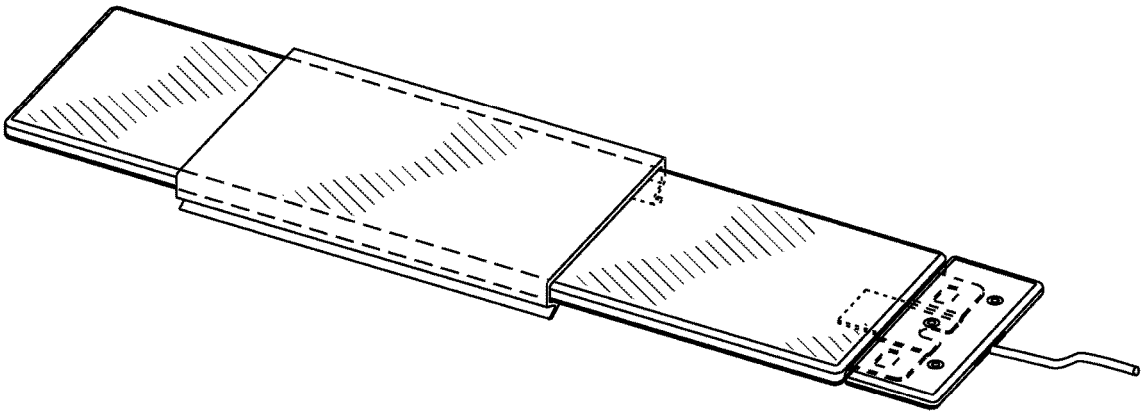
Figure 31A:
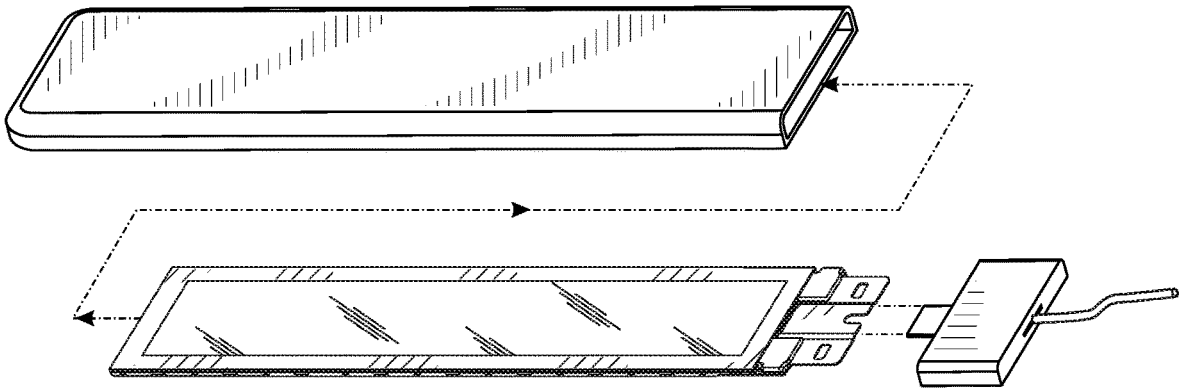
Figure 31B:
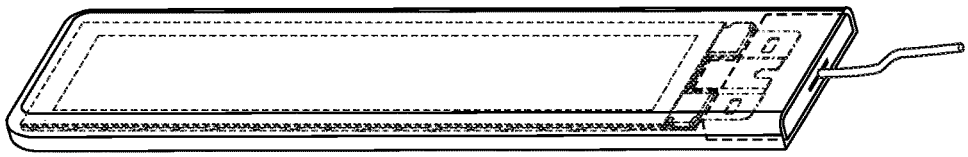

One type of support means for the connected lighting module which is some part of the luminaire different from the lampholder is shown in FIG. 28. In this example, the luminaire has a retaining clip type structure into which connected multiple lighting modules/lampholders can be mounted. The lampholder (not shown) is loosely concealed behind part of the fixture housing and does not provide any support function. As shown in the sequence, a lighting module can be connected to the concealed lampholder and then mounted into the holding part of the luminaire by adjusting its position. Some additional examples of other type of support means for the lighting module side of the electrical connection system are clips or sleeves. FIGS. 29-30 show an embodiment in which the connected light module/lampholder is supported on the lighting module side by an independent spring clip type mounting. FIGS. 31A-31B show an embodiment in which a connected light module/lampholder is mounted within an independent transparent sleeve held by a clip.

The flat detachable electrical connection system can also be part of a non-decorative lighting device or luminaire; for example, an automotive taillight where the lampholder is fixed in a permanent mounting. In this type of embodiment, the electrical connection system is typically not visible.

In general, the lighting module will be located at a terminal end of the lampholder and attached only through the connection to the lampholder. There may be more than one terminally mounted lighting module per lampholder (for example, see FIG. 24). In some embodiments of a luminaire, the lampholder part of the electrical connection system will be attached to a base unit (which can be either freestanding or attached to an object) that anchors the luminaire. In other embodiments of a luminaire, a lampholder part of the electrical connection system is attached at the terminal end of one or more extending arms so that when connected to a lighting module, light is provided at the terminal end of the extending arm. For example, see FIGS. 16-20. These extending arms may be flexible (e.g. see FIG. 22) or rigid, bent or straight. Typically, the extending arms will be hollow and contain low voltage electrical wires to supply power to the male electrical extension of the lampholder part of the detachable connection. The arms may be round, oval, square or rectangular or other shapes in cross-section. The base unit may optionally contain power supplying or modifying features such as a transformer to step-down a higher voltage, batteries, switches or dimmers. There may be more than one terminally mounted lighting module per arm of the luminaire (for example, see FIG. 16 or 20) or there may be multiple arms, each with its own terminally mounted lighting module (for example, see FIG. 22 or 24) electrical connection system In some embodiments, the extending arm may contain one or more movable or adjustable joints. These joints may allow different adjustable positions for the lighting module at the terminal end of the arms. See FIGS. 16-20 for examples. For manufacturing purposes, it is preferred to have the adjustable joint on the lampholder side of the connection instead on the lighting module side of the connection. The adjustable joint may move in any direction as in, for example, a ball and socket joint or be restricted to a single plane of movement as in, for example, a hinge joint. The adjustable joint may allow for an infinite number of positions and use a mechanical feature (for example, a wingnut) to lock the joint in one position. Alternatively, the adjustable joint may have a finite number of possible positions (for example, a hinge joint with a ratchet or click-stop mechanism). This embodiment may optionally have a feature to lock the joint in the desired position. However, the adjustable joint could also be on the lighting module side of the detachable electrical connection in other embodiments.

In the above description, reference is made to the accompanying drawings that form a part hereof, and in which are shown by way of illustration specific embodiments which may be practiced. These embodiments are described in detail to enable those skilled in the art to practice the invention, and it is to be understood that other embodiments may be utilized and that structural, logical and electrical changes may be made without departing from the scope of the present invention. The description of any example embodiments is, therefore, not to be taken in a limiting sense. Although the present invention has been described for the purpose of illustration, it is understood that such detail is solely for that purpose and variations can be made by those skilled in the art without departing from the spirit and scope of the invention.

Parts List

| Reference | Description |
|---|---|
| 1 | mechanical support plate |
| 2 | panel support area |
| 3 | male mechanical support connector section |
| 4 | depressed channel |
| 5 | wings |
| 6 | holes for engaging lannpholder to form a flat non-permanent connection |
| 40 | leading edge of male mechanical support section |
| 7 | bare lighting module (no housing) |
| 8 | light panel |
| 9 | PCB |
| 10 | overnnolded plastic extension |
| 11 | complete flat lighting module |
| 12 | solid back cover plate |
| 13 | lighting panel |
| 14 | internal holding frame |
| 15 | adhesive tape to overnnold assembly |
| 16 | Insulating Teflon tape |
| 17 | front cover plate w/opening for emission |

-continued

| Parts List | |
|---|---|
| Reference | Description |
| 18 | notch in leading edge |
| 19 | contact pads on one end for connection |
| 20 | lannpholder |
| 21 | bottom plate of female mechanical connector of lannpholder |
| 22 | grooves in female mechanical connector of lannpholder |
| 23 | post structure (engages notch 18 while connected) |
| 24 | male electrical extension |
| 24a, b | male electrical extension (contact pads not shown) |
| 25 | top plate of female mechanical connector of lampholder |
| 26 | deformable springs (fit in holes 6 in FIGS. 1 & 2) |
| 27 | single orientation lannpholder |
| 28 | bottom plate of single orientation lannpholder |
| 29 | solid extension in bottom plate of single orientation lampholder |
| 30 | electrical contact pads in male electrical |
| 31 | electrical connectors |
| 32 | contact pad areas to electrical connectors |
| 34 | test points on PCB that fit into slots (FIGS. 3 & 4) |
| 35 | curved lighting module |
| 36 | slots in support plate (FIG. 4) |
| 37 | flexible lighting module |
| 40 | leading edge of male mechanical support connector section |
| 42 | spring plate |
| 44 | long finger spring (top surface of groove) |
| 46 | protruding retaining arm for long finger spring |
| 50 | lannpholder |
| 60 | transition region |

The invention claimed is:

1. A flat and detachable electrical connection system between a lighting module and a lampholder; comprising:

the lighting module whose thickness is less than its width or length comprising a lighting panel, control circuitry for controlling the lighting panel, and electrical contact pads connected to the control circuitry, all supported at least in part by a mechanical support plate; the mechanical support plate being at least partially enclosed in a housing with a provision or opening so that light can be emitted from the lighting panel; and where the mechanical support plate includes a male mechanical support connector section that extends out from the mechanical support plate in the same plane as the thickness of the lighting module; and where the male mechanical support connector section includes means for non-permanent locking or latching of the lighting module to the lampholder; and the lampholder comprising a female mechanical connector into which the male mechanical support connector section of the lighting module engages and which includes means for non-permanent locking or latching of the male mechanical support connector section of the lighting module; and a male electrical extension that extends out from and past the female mechanical connector and which engages the electrical contact pads in the lighting module to supply electrical power or communication signals or both to the control circuitry when the lighting module and lampholder are connected.

2. The electrical connection system of claim 1 wherein the male mechanical support connector section is not covered by the housing.

3. The electrical connection system of claim 1 wherein the male mechanical support connector section of the lighting module includes two wings located along the sides of a depressed channel; the female mechanical connector includes two grooves configured to engage the wings of the male mechanical support section; wherein when the lighting module and lampholder are connected:

the two wings of the male mechanical support section engage with the two corresponding grooves of the female mechanical connector; and the male electrical extension of the lampholder fits along the depressed channel of the male mechanical support section to make contact with the electrical contact pads of the lighting module.

4. The electrical connection system of claim 3 wherein the depressed channel of the male mechanical support connector section includes one or more notches in its leading edge that engage against corresponding springs, posts, pins or vertical structures located beneath and/or above the male electric extension of the lampholder.

5. The electrical connection system of claim 3 wherein the electrical contact pads of the lighting module are positioned over the depressed channel of the male mechanical support connector section so that the surface of the electrical contact pads aligns with the level of the wings.

6. The electrical connection system of claim 1 wherein the lighting panel is LED or OLED.

7. The electrical connection system of claim 1 wherein the male mechanical support connector section of the lighting module fits into the lampholder in two different orientations.

8. The electrical connection system of claim 1 wherein the male mechanical support connector section of the lighting module fits into the lampholder in a single orientation.

9. The electrical connection system of claim 1 wherein the mechanical support plate is larger than the lighting panel so that the entire lighting panel is supported.

10. The electrical connection system of claim 1 wherein the mechanical support plate is smaller than the lighting panel so that the lighting panel is only partially supported.

11. The electrical connection system of claim 1 wherein the control circuitry of the lighting module is a PCB.

12. The electrical connection system of claim 1 wherein the lighting module includes multiple lighting panels.

13. A lighting module whose thickness is less than its width or length comprising at least one lighting panel, control circuitry for controlling the lighting panel(s), and electrical contact pads connected to the control circuitry, all supported at least in part by a mechanical support plate; the mechanical support plate being at least partially enclosed in a housing with a provision or opening so that light can be emitted from the lighting panel; and where the mechanical support plate includes at least one male mechanical support connector section wherein:

the male mechanical support connector section extends out from the mechanical support plate in the same plane as the thickness of the lighting module;

the male mechanical support connector section is not covered by the housing;

the male mechanical support connector section includes means for non-permanent locking or latching when inserted into a corresponding receiver; and the male mechanical support connector section includes two wings located along the sides of a depressed channel.

14. The lighting module of claim 13 where the depressed channel of male mechanical support connector section has one or more notches in its leading edge.

15. The lighting module of claim 13 wherein a first flat lighting module additionally includes at least one lampholder; the lampholder comprising a female mechanical connector into which the male mechanical support connector section of a second flat lighting module engages and which includes means for non-permanent locking or latching of the male mechanical support connector section of the second flat lighting module; and a male electrical extension which engages the electrical contact pads in the second lighting module to supply electrical power or communication signals or both to the control circuitry of the second flat lighting module when the second flat lighting module and the lampholder of the first lighting module are connected.

16. The lighting module of claim 13 wherein the mechanical support plate includes at least two separate male mechanical support connector sections.

17. A lampholder for engaging a lighting module with a male mechanical support connector section and electrical contact pads comprising:

a female mechanical connector with two grooves configured to interact with the male mechanical support connector section of the lighting module;

means for non-permanent locking or latching to a corresponding male connector; and a male electrical extension that extends out from and past the female mechanical connector and which engages the electrical contact pads within the lighting module.

18. The lampholder of claim 17 wherein the female mechanical connector additionally has springs, posts, pins or vertical structures located beneath and/or above the male electric extension of the lampholder.

19. A luminaire comprising a flat detachable electrical connection system, wherein the flat detachable electrical connection system comprises:

a lighting module whose thickness is less than its width or length comprising a lighting panel as a light source, control circuitry for controlling the lighting panel, and electrical contact pads connected to the control circuitry, all supported at least in part by a mechanical support plate; the mechanical support plate being at least partially enclosed in a housing with a provision or opening so that light can be emitted from the lighting panel; and where the mechanical support plate includes a male mechanical support connector section that extends out from the mechanical support plate in the same plane as the thickness of the lighting module; and where the male mechanical support connector section includes means for non-permanent locking or latching of the lighting module to a lampholder; and the lampholder comprising a female mechanical connector into which the male mechanical support connector section of the lighting module engages and which includes means for non-permanent locking or latching of the male mechanical support connector section of the lighting module; and a male electrical extension that extends out from and past the female mechanical connector and which engages the electrical contact pads in the lighting module to supply electrical power or communication signals or both to the control circuitry when the lighting module and lampholder are connected.

20. The luminaire according to claim 19 where the luminaire has a base unit, either freestanding or attached to an object, that anchors the luminaire and one or more extending arm(s), where at least one of the extending arm(s) terminates with the lampholder of the flat detachable electrical connection system.

21. The luminaire according to claim 20 where the extending arm(s) contains one or more movable or adjustable joints.

* * * * *